US007534950B2

(12) United States Patent
Lyles

(10) Patent No.: US 7,534,950 B2
(45) Date of Patent: May 19, 2009

(54) STRINGED INSTRUMENT THAT MAINTAINS RELATIVE TUNE

(76) Inventor: Cosmos M. Lyles, 101 3rd Ave., New York, NY (US) 10003

( * ) Notice: Subject to any disclaimer, the term of this patent is extended or adjusted under 35 U.S.C. 154(b) by 394 days.

(21) Appl. No.: 11/484,467

(22) Filed: Jul. 11, 2006

(65) Prior Publication Data

US 2007/0012161 A1 Jan. 18, 2007

Related U.S. Application Data

(60) Provisional application No. 60/698,027, filed on Jul. 11, 2005.

(51) Int. Cl.
*G10D 9/00* (2006.01)

(52) U.S. Cl. ..... 84/453

(58) Field of Classification Search ..... 84/297 S, 84/297 R, 453, 454
See application file for complete search history.

(56) References Cited

U.S. PATENT DOCUMENTS

| | | | | |
|---|---|---|---|---|
| 2,614,449 | A | 10/1952 | Machalek | |
| 3,136,198 | A | 6/1964 | Smith et al. | |
| 3,583,272 | A | 6/1971 | Eurich | |
| 3,780,612 | A | 12/1973 | Robinson | |
| 4,020,730 | A | 5/1977 | Hill | |
| 4,130,045 | A | 12/1978 | Walker | |
| 4,137,812 | A | 2/1979 | Franzmann | |
| 4,138,919 | A | 2/1979 | Miller | |
| 4,170,161 | A | 10/1979 | Kaftan | |
| 4,348,934 | A | 9/1982 | Ogata | |
| 4,375,180 | A | 3/1983 | Scholz | |
| 4,656,915 | A | 4/1987 | Osuga | |
| 4,704,935 | A | 11/1987 | Franklin | |
| 4,760,622 | A | 8/1988 | Rohrman | |
| 4,777,858 | A | 10/1988 | Petschulat et al. | |
| 4,856,404 | A | 8/1989 | Hughes, Sr. | |
| 4,909,126 | A | 3/1990 | Skinn et al. | |
| 4,955,275 | A * | 9/1990 | Gunn | 84/313 |
| 5,040,741 | A | 8/1991 | Brown | |
| 5,080,295 | A | 1/1992 | Hongo et al. | |
| 5,097,737 | A | 3/1992 | Uhrig | |
| 5,173,565 | A | 12/1992 | Gunn | |
| 5,293,804 | A | 3/1994 | Myers | |

(Continued)

FOREIGN PATENT DOCUMENTS

| | | |
|---|---|---|
| WO | WO 00/38172 | 6/2000 |

(Continued)

*Primary Examiner*—Kimberly R Lockett
(74) *Attorney, Agent, or Firm*—Knobbe, Martens, Olson & Bear, LLP.

(57) ABSTRACT

A stringed musical instrument includes a string mounting arrangement that enables multiple strings to be maintained in relative tune as the pitch of the strings is simultaneously varied. In one embodiment, a composite musical string comprises multiple segments, each segment having a different density, but the composite string will maintain substantially the same tension throughout its length. As the tension is increased or decreased, the pitch of the instrument changes, but the relative tuning between the strings remains. In another embodiment, a composite string comprises musical string segments joined end-to-end with bending segments. The musical segments are adapted to emit desired notes and tones at tension. The bending segments are adapted to easily bend about pivots such as a tuning knob or pulley.

22 Claims, 21 Drawing Sheets

U.S. PATENT DOCUMENTS

| | | | |
|---|---|---|---|
| 5,323,680 | A | 6/1994 | Miller et al. |
| 5,343,793 | A | 9/1994 | Pattie |
| 5,377,926 | A | 1/1995 | Min |
| 5,390,579 | A | 2/1995 | Burgon |
| 5,637,820 | A | 6/1997 | Wittman |
| 5,734,117 | A | 3/1998 | Tanzella |
| 5,756,913 | A | 5/1998 | Gilmore |
| 5,824,929 | A | 10/1998 | Freeland et al. |
| 5,859,378 | A | 1/1999 | Freeland et al. |
| 5,883,319 | A | 3/1999 | Hebestreit et al. |
| 5,886,270 | A | 3/1999 | Wynn |
| RE36,484 | E | 1/2000 | Turner |
| 6,069,306 | A | 5/2000 | Isvan et al. |
| 6,437,226 | B2 | 8/2002 | Oudshoorn et al. |
| 6,528,709 | B2 | 3/2003 | Hebestreit et al. |
| 6,559,369 | B1 | 5/2003 | Gilmore |
| 6,580,021 | B2 | 6/2003 | Barney |
| 6,723,904 | B1 | 4/2004 | Dolan et al. |
| 2003/0094087 | A1 | 5/2003 | Gregory |
| 2007/0006712 | A1 | 1/2007 | Lyles |
| 2007/0214931 | A1 | 9/2007 | Lyles |
| 2007/0214935 | A1 | 9/2007 | Lyles |
| 2008/0196571 | A1 | 8/2008 | Lyles |

FOREIGN PATENT DOCUMENTS

| | | |
|---|---|---|
| WO | WO2007/008785 | 1/2007 |
| WO | WO2007/106600 | 9/2007 |

* cited by examiner

STRINGED INSTRUMENT THAT MAINTAINS RELATIVE TUNE

CROSS-REFERENCE TO RELATED APPLICATIONS

This application claims the benefit of U.S. Provisional Application No. 60/698,027, which was filed on Jul. 11, 2005, The entirety of which is hereby incorporated by reference. The entirety of Applicant's copending U.S. application Ser. No. 11/356,486, which was filed on Feb. 17, 2006, is also hereby incorporated by reference.

BACKGROUND OF THE INVENTION

1. Field of the Invention

The present invention relates generally to stringed musical instruments, and more particularly to stringed instruments that maintain relative tune during string tension adjustments.

2. Description of the Related Art

Stringed musical instruments create music when strings of the instrument vibrate at wave frequencies corresponding to desired musical notes. Such strings typically are held at a relatively high tension, and the musical note emitted by the string is a function of the vibration frequency, length, tension, material and density of the string. The natural frequency of the vibrating string is described by the following wave equation:

$$f=(\tfrac{1}{2}L)(T/d)^{1/2}$$

In this equation, f is the natural frequency of vibration, T is the tension on the string, d is the density of the string (in mass per unit length), and L is the length of the relevant portion of the string. Stringed musical instruments typically include a plurality of musical strings arranged generally parallel to one another. Preferably, the strings are configured to emit different notes when caused to vibrate. During use, the musician may vary the frequency of the string by pressing down on the string at a certain point in order to vary the effective length of the string, thus correspondingly changing the natural vibration frequency. The emitted musical note changes with the change in vibration frequency. As indicated by the equation, the vibration frequency is inversely proportional to the length of the vibrating portion of the string; thus, as the musician effectively shortens the string, the frequency of vibration increases, and thus the pitch of the emitted musical note correspondingly increases.

Each string of a stringed musical instrument typically is tensioned in relative tune to the other strings in order to facilitate predictable playing of chords and scales. This state, commonly referred to as being "in tune," means that the natural frequency of the strings vary from one another by a predetermined interval. For example, conventional tuning of a guitar is such that the string at the lowest frequency is tuned to E, and subsequent strings are tuned to A, D, G, B and E. As such, each string is five half steps (the smallest frequency individually used in the standard 12-tone scale) higher than the previous string, except the G to B interval which is 4 steps. Adding all of the intervals, there are 24 half steps, which is two octaves (12 half steps being one octave).

An octave is the musical interval at which the frequency of the upper note is exactly twice that of the lower note. The frequency of vibration of the low E string and the high E string of a guitar are such that the emitted musical notes are two octaves away from each other. As indicated by the equation, a frequency may be doubled by halving the length of a musical string when the tension and density of the string are held constant. Different approaches are used, depending on which factors are desired and kept constant. For example, in order for the low E string and the high E string to be two octaves apart in a guitar in which the string lengths are equal, the tension on the high E string must be 16 times that of the low E string, or the density of the high E string must be 1/16 that of the low E string, or a combination of tension and density differences must create a factor of 16 so that when the square root of the term T/d is taken the result is 4, which indicates quadrupling of frequency in accordance with a two octave interval.

In conventional musical instruments, such as guitars, the tension of the strings relative to one another does not vary dramatically, mostly because of practical concerns. For example, too much tension may cause a string to be especially subject to breakage; too little tension may result in a string being so slack that it may contact the instrument body or interfere with other strings when vibrating during play. Accordingly, typically the density (mass per unit length) of the strings varies widely between strings in order to obtain a set of strings having the desired natural frequencies. For guitars, strings are sold in sets of six, with each string being weighted to produce its particular desired frequency within desired tension ranges.

Typically, guitar strings are fixed to the guitar at one end and attached to rotatable tuning knobs at the other end so that each string may be tightened with a suitable tension. Each string typically has its own knob (also called a tuning key). Stringing a guitar involves affixing one end of each guitar string to a mount on the body of the guitar, aligning the string in its place across the neck, and tightening and tuning the string by connecting it to its corresponding tuning key. Such stringing can be a time-consuming process.

Tuning a guitar is performed by turning each knob so as to tighten or slacken the string until the desired frequency is obtained. Tuning stringed instruments such as guitars can be time-consuming and difficult. Typically, a guitarist first correctly tunes the lower E string, and then progressively tunes the adjacent strings. For example, the E string is shortened (by pushing it against the guitar neck) to a position that produces an A note, and the adjacent A string is tuned by ear to match the A note as played on the E string. The D string adjacent to the A string is similarly tuned relative to the A string, as are the rest of the G, B and E strings progressively tuned relative to the adjacent strings. Such tuning by ear is typically very difficult for beginners and for those without a good sense of musical tones. Also, such tuning requires a reference note to start, and such reference note is usually provided by a different instrument, and it has a different timbre than does a guitar, thus further complicating tuning.

A piano typically contains about 220 strings. Typically, piano tuning is accomplished in much the same manner as a guitar tuning, and all 220 strings are adjusted relative to one another.

On occasion, a guitarist may desire to change the pitch of his instrument in order to play a particular song. This can be accomplished by using a device known as a capo, which wraps around the neck of the guitar and can effectively shorten the length of all of the guitar strings, thus increasing the frequency and correspondingly increasing the emitted pitch of all of the strings, while maintaining the strings in relative tune. However, this operation relatively shortens the neck of the guitar, which may be undesired. Also, the guitarist must change the position of his fingers along the neck to play chords and such. Thus, it can be desired to completely retune the guitar to a higher pitch. This typically necessitates retuning the low E string, then the A, D and so on, which is difficult and time consuming. It is thus impractical to retune a typical guitar during a playing session.

SUMMARY OF THE INVENTION

Accordingly, there is a need in the art for a stringed musical instrument that is relatively quick and easy to string. There is also a need for a stringed musical instrument in which the strings can be easily placed into relative tune and maintained in relative tune. Additionally, there is a need for a stringed musical instrument in which the strings can be easily placed into absolute tune and maintained in such absolute tune over time. Further, there is a need in the art for a musical instrument in which the emitted pitch of the strings can be easily changed while generally maintaining a relative tune between the strings.

In accordance with one embodiment, a stringed musical instrument is provided, comprising a musical string and a string mounting system. The musical string comprises a first elongate segment and a second elongate segment, the first and second segments being connected to one another. The mounting system is configured so that harmonic vibrations in the first segment are substantially isolated from the second segment.

In another embodiment, the mounting system is configured to maintain the first and second segments at substantially the same string tension. In yet another embodiment, the mounting system comprises a pivot, and the musical string is at least partially wrapped about the pivot so that a direction of the string changes at the pivot. In one embodiment, string tension is communicated across the pivot so that portions of the musical string on either side of the pivot are at substantially the same tension.

In further embodiments, a first end of the string is attached to an anchor and a second end of the string is attached to a tensioner, and the tensioner is adapted to change the tension in the string. In a still further embodiment, the musical string is arranged in a continuous loop.

In yet another embodiment, the mounting system and vibration separators are configured to maintain the first and second segments at substantially the same string tension. In still a further embodiment, the first and second segments have a different mass per unit length. In still another embodiment, the string mounting system is configured to maintain the tension of the first string segment at a substantially constant ratio to the tension of the second string segment.

In accordance with still another embodiment, the present invention provides a stringed musical instrument. The instrument comprises a plurality of musical string segments, each string segment having a harmonic frequency corresponding to a string tension and a string length. Vibration of the string segment at the harmonic frequency emits sound at a corresponding musical note, and the plurality of string segments are tuned so that each of the segments emits a different musical note in accordance with a relative tuning pattern. A string mounting system is configured to hold each string segment at a desired tension. A string tension adjustment system is configured to simultaneously change the tension of each of the plurality of string segments in a manner so that the emitted musical notes of the string segments change with the changing tension, but the relative tuning pattern of the notes emitted by the respective string segments remains substantially the same.

In another embodiment, the tension adjustment system is configured so that actuation of the adjustment system changes the tension in one of the segments to a greater degree than in another of the segments.

In accordance with a still further embodiment of the invention, a musical string system is provided, comprising a plurality of string segments joined end-to-end so that each of the string segments is at substantially the same tension. The system is configured so that each string segment has a different harmonic frequency at the tension.

In accordance with yet another embodiment, a stringed musical instrument is provided. The instrument comprises a composite string and a string mounting system. The composite string comprises a first elongate segment and a second elongate segment that are joined end-to-end. The second segment is more pliable in bending than the first segment. The string mounting system has a pivot member. The second segment is at least partially wrapped about the pivot member so that the direction of the composite string changes at the pivot.

In another embodiment a vibration separator defines a playing zone and a mount zone, and string vibrations are isolated by the vibration separator between the playing zone and mount zone. In a further embodiment, the pivot member is disposed in the mount zone. In yet a further embodiment, the first segment extends through the playing zone, and the second segment is disposed in the mount zone.

In one embodiment, the pivot member comprises a tuning knob. In another embodiment, the pivot member comprises a pulley. In a further embodiment, substantially no tension in the composite string is applied to bending the second segment about the pulley.

In yet another embodiment, the first and second segments are selectively detachable from one another. In other embodiments, the second segment has a width and a thickness, and the width is greater than the thickness such as in a belt. In still other embodiments, the second segment comprises a plurality of filaments.

In accordance with still a further embodiment, the present invention provides a stringed musical instrument comprising a composite string and a string mounting system. The composite string comprises a plurality of musical string segments and a plurality of bending string segments. A bending segment is interposed between adjacent musical segments. The string mounting system has a plurality of pivots. The composite string is at least partially wrapped about the pivots so that a direction of the composite string changes at each pivot. The mounting system is configured so that the bending segments engage the pivots and the musical segments do not engage the pivots. Each musical string segment has a harmonic frequency corresponding to a string tension and a string length so that vibration of the musical string segment at the harmonic frequency emits sound at a corresponding musical note. Each bending segment is more pliable in bending than the adjacent musical segments. The string mounting system is configured to hold each string segment at a desired tension so that the plurality of musical string segments are tuned so that each of the musical segments emits a different musical note in accordance with a relative tuning pattern when the composite string is held at a tension. A string tension adjustment system is configured to simultaneously change the tension of each of the plurality of string segments in a manner so that the emitted musical notes of the musical string segments change with the changing tension, but the relative tuning pattern of the notes emitted by the respective musical string segments remains substantially the same.

DETAILED DESCRIPTION OF PREFERRED EMBODIMENTS

The following description presents embodiments illustrating aspects of the present invention. It is to be understood that various types of musical instruments can be constructed using aspects and principles as described herein, and embodiments are not to be limited to the illustrated and/or specifically-discussed examples, but may selectively employ various aspects and/or principles disclosed in this application.

Figure 1:
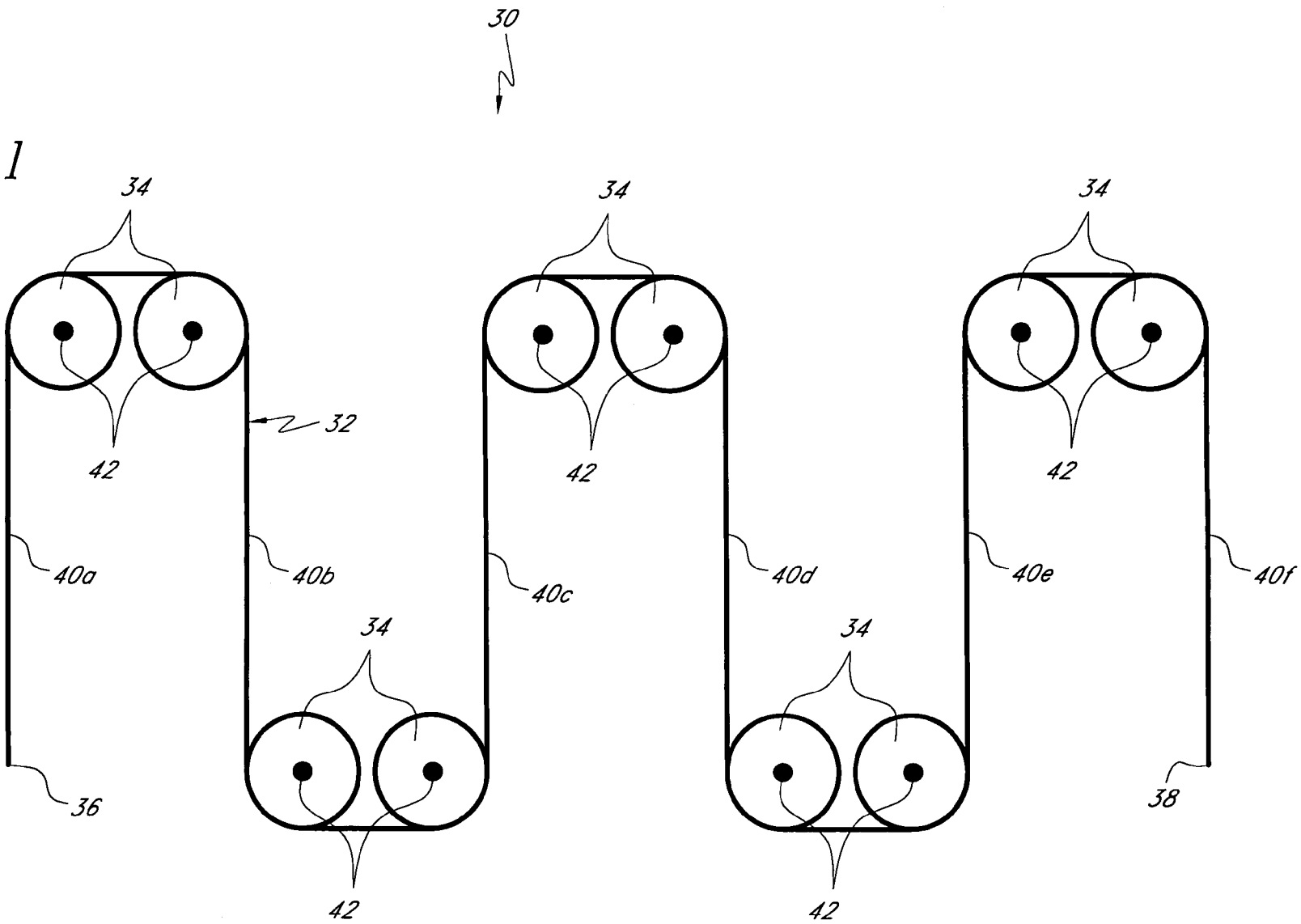
FIG. 1 schematically illustrates an embodiment of a musical string mounting system having a single string divided into a plurality of segments.

With first reference to FIG. 1, one embodiment of a musical instrument string arrangement 30 is illustrated. In the illustrated embodiment, a single musical string 32 is routed through a plurality of rotatable pulleys 34. A fixed end 36 of the string 32 is affixed to an anchor mechanism which is preferably affixed to a body of the associated musical instrument. A torque end 38 of the string 32 is connected to a mechanism, such as a tuning knob, that is adapted to tighten the string, thus increasing the tension throughout the musical string 32.

In the illustrated embodiment, the string is divided into six generally parallel segments 40*a-f* between rotatable pulleys 34. Preferably, the pulleys 34 are each adapted to rotate about an axis 42, and thus evenly distribute tension throughout the entire string 32. As such, each of the segments 40*a-f* is at substantially the same tension. Further, the pulleys 34 preferably isolate vibrations in each segment from other segments. Preferably the segments 40*a-f* are substantially the same length. Since the length and tension are substantially the same, and since the segments are comprised of a single string 32 which, in the illustrated embodiment, has a substantially constant density, the frequency of vibration of each string segment 40*a-f* is substantially the same.

In additional embodiments, the frequency of vibration of the respective segments can be varied by making certain adjustments. For example, the position of the pulleys 34 can be arranged such that the length of different segments 40*a-f* varies, thus resulting in different frequencies. Additionally, in additional illustrated embodiments, string segments may have different density such as, for example, by adding a winding of additional musical string about the respective string segment. In one embodiment, each segment 40*a-f* of the continuous string 32 is treated and/or modified to have a different density. As such, even though each of the string segments is under the same tension, each vibrates at a different frequency because of the difference in density and/or other treatment. It is to be understood that such densities can be customized as desired by the musician. Thus, the embodiment of FIG. 1, which illustrates six string segments 40*a-f*, can be modified so as to be acceptable for a guitar, which typically includes six strings. Of course, other more simple or more complex instruments can be created using these principles.

In the embodiment illustrated in FIG. 1, the plurality of rotatable pulleys 32 are employed to change the direction of the string 32, to vibrationally isolate string segments 40*a-f* from one another, and to communicate tension substantially uniformly throughout the string 32. It is to be understood that, in additional embodiments, structures other than pulleys can be employed. For purposes of this specification, the term "tension communicating pivot," or just "pivot" refers to a structure about which a string is at least partially wrapped, and which structure changes the direction of the string while also communicating tension across the pivot so that the tension of the string on either side of the pivot is substantially the same. As such, the tension communicating pivot structure typically allows movement of the string over and/or across the pivot in order to easily distribute tension forces.

Suitable tension communicating pivots may include rotating pulleys, as in the illustrated embodiment, but may also include other structures such as a ball bearing, wheel, gear, and/or a peg or bar having a low friction surface such as a polished surface or a Teflon coating. It is also to be understood that, in certain circumstances, a pivot structure, at which a string is partially wrapped to change the direction of the string, may be specifically adapted not to communicate a tension thereacross. For example, certain surface coatings or treatments on a peg, bar or the like may increase friction so as to prevent or resist movement of a string over the surface of the pivot, and thus prevent communication of tension across the pivot. However, for purposes of this specification, reference to a "pivot" refers to a tension communicating pivot unless specifically described as otherwise.

Figure 2:
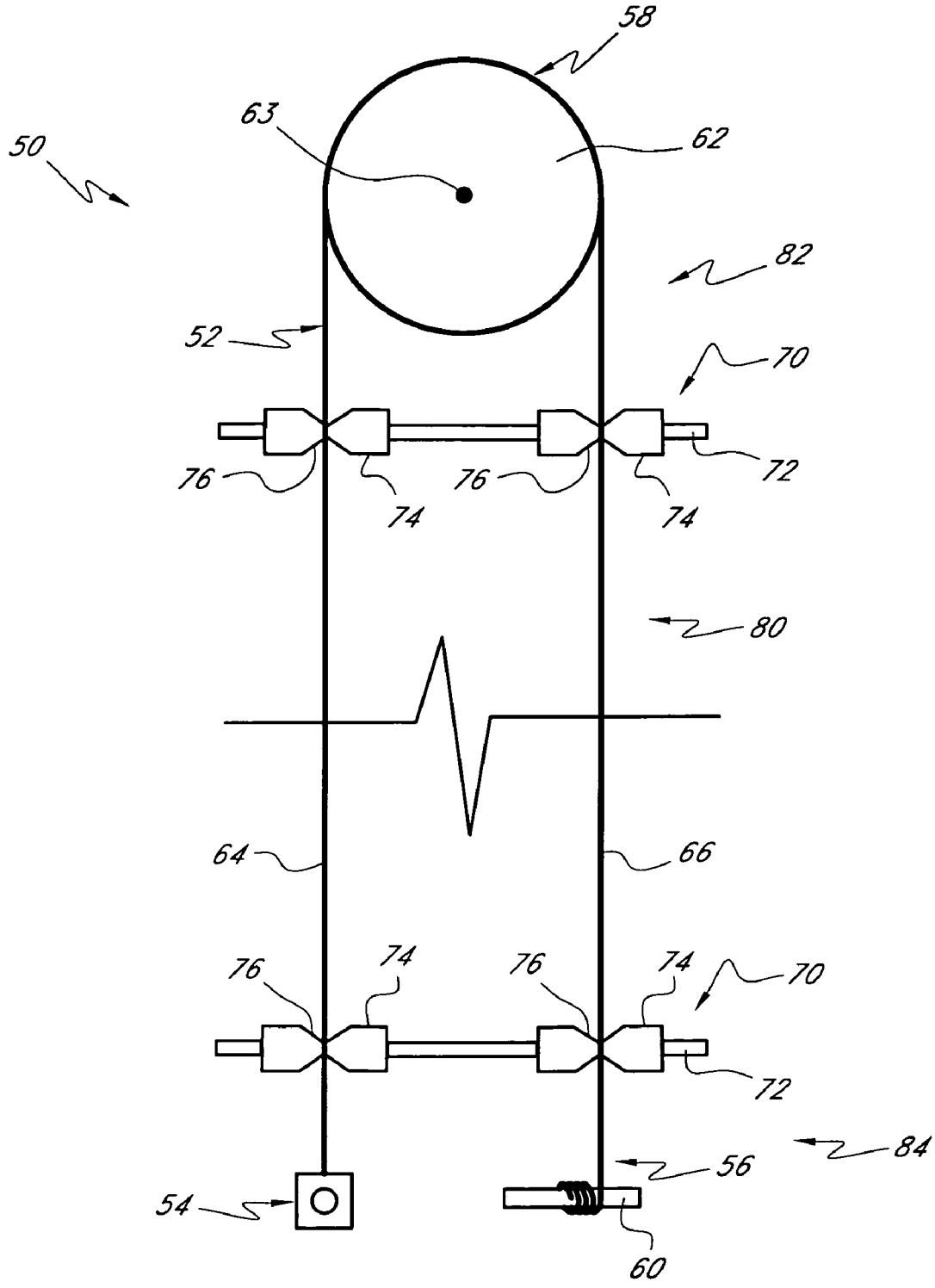
FIG. 2 schematically illustrates another embodiment of a musical string mounting system.

With reference next to FIG. 2, another embodiment of a musical string mounting system 50 is illustrated. In the illustrated embodiment, a single string 52 comprises an anchor end 54 and a free end 56. In the embodiment, the anchor 54 is affixed to the corresponding musical instrument, and is rotated about a pivot 58 and back to a tensioner 60. The free end 56 is attached to the tensioner 60, which preferably comprises a tuning key that is mounted to the musical instrument. As the tuning key 60 is rotated, the string 52 is tightened. In the illustrated embodiment, the pivot 58 comprises a pulley 62 that is rotatable about an axis 63, and which communicates tension across the pulley 62. A first segment 64 of the string 52 is defined between the anchor 54 and the pulley 62, and a second segment 66 of the string 52 is defined between the pulley 52 and the tensioner 60.

In the illustrated embodiment, a pair of vibration separator portions 70 are provided. Each vibration separator portion 70 comprises a separator mount 72 on which a separator body 74 is rotatably mounted. The illustrated separator bodies 74 comprise generally cylindrical rollers, each having a shaped groove 76 or notch that acts as a saddle to hold the string 52 in a desired alignment. The separators 70 are adapted to communicate tension thereacross, but to substantially isolate vibrations from crossing the separators 70.

With continued reference to FIG. 2, a playing zone 80 is defined between the vibration separator portions 70. Mount zones 82, 84 are defined on the sides of the separator portions 70 opposite the playing zone 80. Specifically, a first mount zone 82 includes the pivot pulley 62; a second mount zone 84 includes the anchor 54 and tensioner 60. The portions of the string segments 64, 66 in the playing zone 80 are vibrationally isolated from the string in the mount zones 82, 84. It is anticipated that the string portions in the playing zone 80 will be used by the musician to make music.

Figure 3:
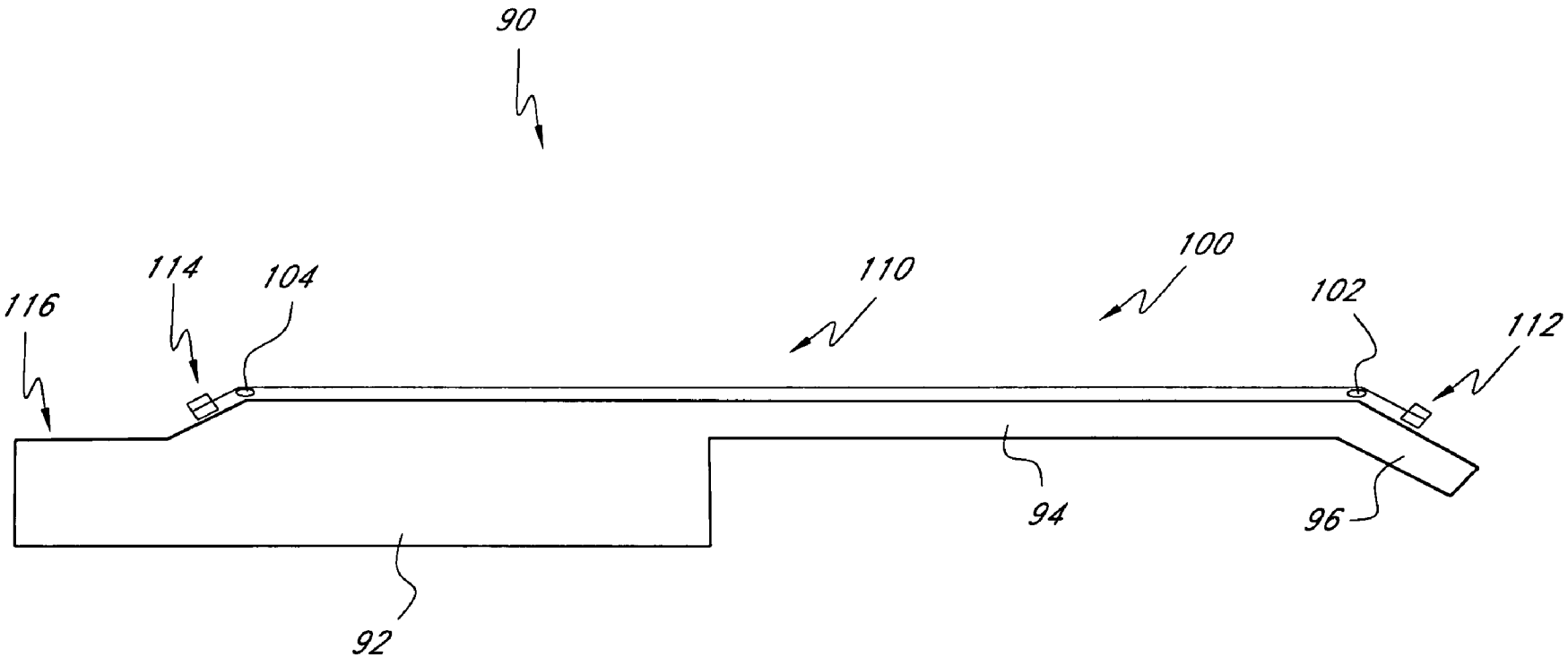
FIG. 3 is a side view of an embodiment of a guitar employing a string mounting system in accordance with an embodiment.

With reference also to FIG. 3, a guitar 90 comprises a body 92, neck 94, and head 96. Preferably, a musical string mounting system 100 incorporating principles of the system described in FIG. 2 is disposed on the guitar 90. As shown, a first vibration separator portion 102 is defined between the neck 94 and head 96 and is comparable to the nut of a conventional guitar. A second vibration separator portion 104 is placed on the body 92 and is comparable to the bridge of a conventional guitar. A playing zone 110 is defined between the first and second vibration separator portions 102, 104. A first mounting zone 112 is defined on the neck 94/head 96 opposite the playing zone 110. A second mount zone 114 is defined on the body 92 opposite the second separation portion 104 from the playing zone 110. The second mount zone 114 is comparable to the stop tailpiece of a conventional guitar. In the illustrated embodiment, the guitar body 92 includes a recessed portion 116 that assists in applying certain pressure to the bridge separator portion 104 in order to assist vibration isolation. It is to be understood, however, that other embodiments may not employ such a recess 116. In the illustrated embodiment, the string portions in the playing zone 110 are vibrationally isolated from vibrations that may occur in either mount zone 112, 114.

Figure 4:
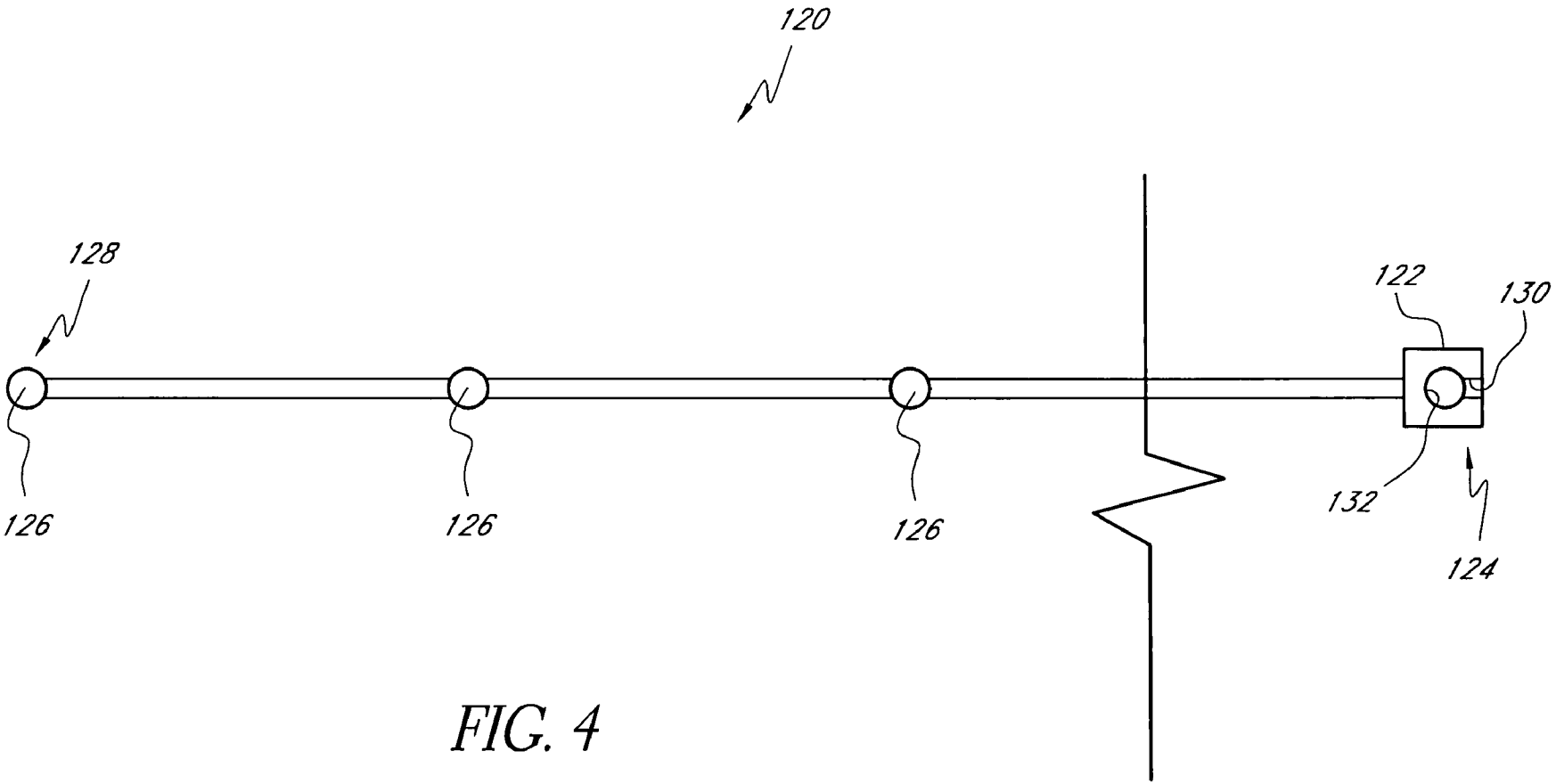
FIG. 4 illustrates an embodiment of a musical string.
Figure 5:
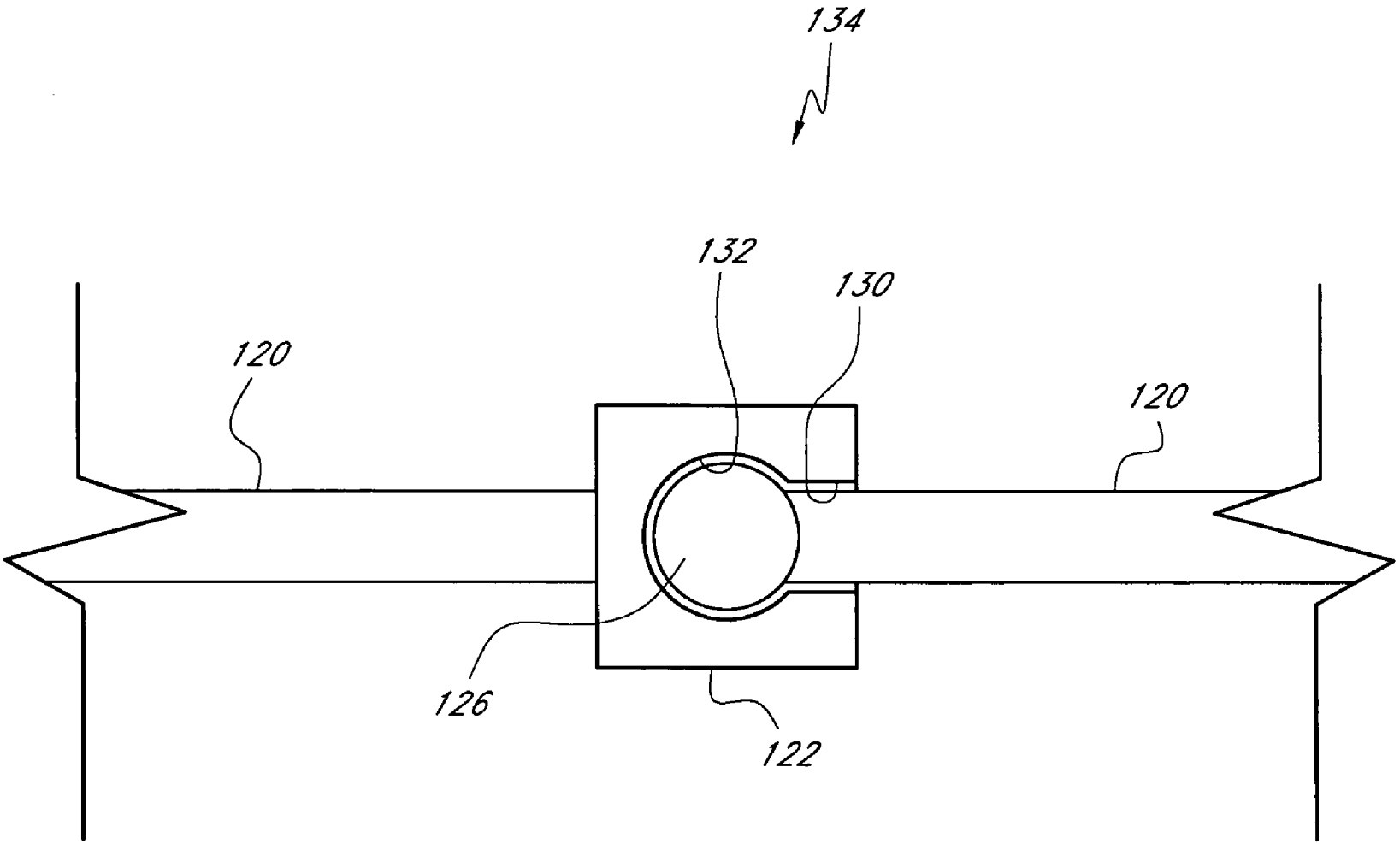
FIG. 5 illustrates a portion of the string of FIG. 4 connected end-to-end with another string.

With reference next to FIGS. 4 and 5, an embodiment of a string system is presented. With particular reference to FIG. 4, an embodiment of an elongate musical string 120 preferably comprises a connector 122 at a first end 124 and a plurality of spaced apart balls 126 at or adjacent a second end 128. Preferably, the connector 122 comprises a slot 130 sized and adapted to receive the string 120 and a ball mount 132 that is sized and adapted to receive one of the balls 126.

With particular reference next to FIG. 5, two string segments 120 can be joined end-to-end by inserting a ball 126 of one string 120 into the ball mount 132 of the connector 122 of an adjoining string 120. The user may choose one of the plurality of balls 126 depending on the length of string segment that is desired. Preferably, excess string is trimmed. As a result, string segments 120 can be joined end-to-end to form a single composite string 134. Preferably, individual string segments 120 have different properties such as, for example, different densities. Other variations, such as properties that influence timbre, tone color, or the like, are also contemplated.

Although the embodiment illustrated in FIGS. 4 and 5 uses a ball-and-connector construction, it is to be understood that other structures may advantageously be used to connect string segments 120 end-to-end. For example, the shape of the ball 126 and/or connector 122 may be modified as desired. Additionally, other methods, such as sleeve locks, engaging hooks and loops, welding, tying, knotting, and combinations thereof, as well as other structural variations, can be used to join string segments end-to-end.

Figure 6:
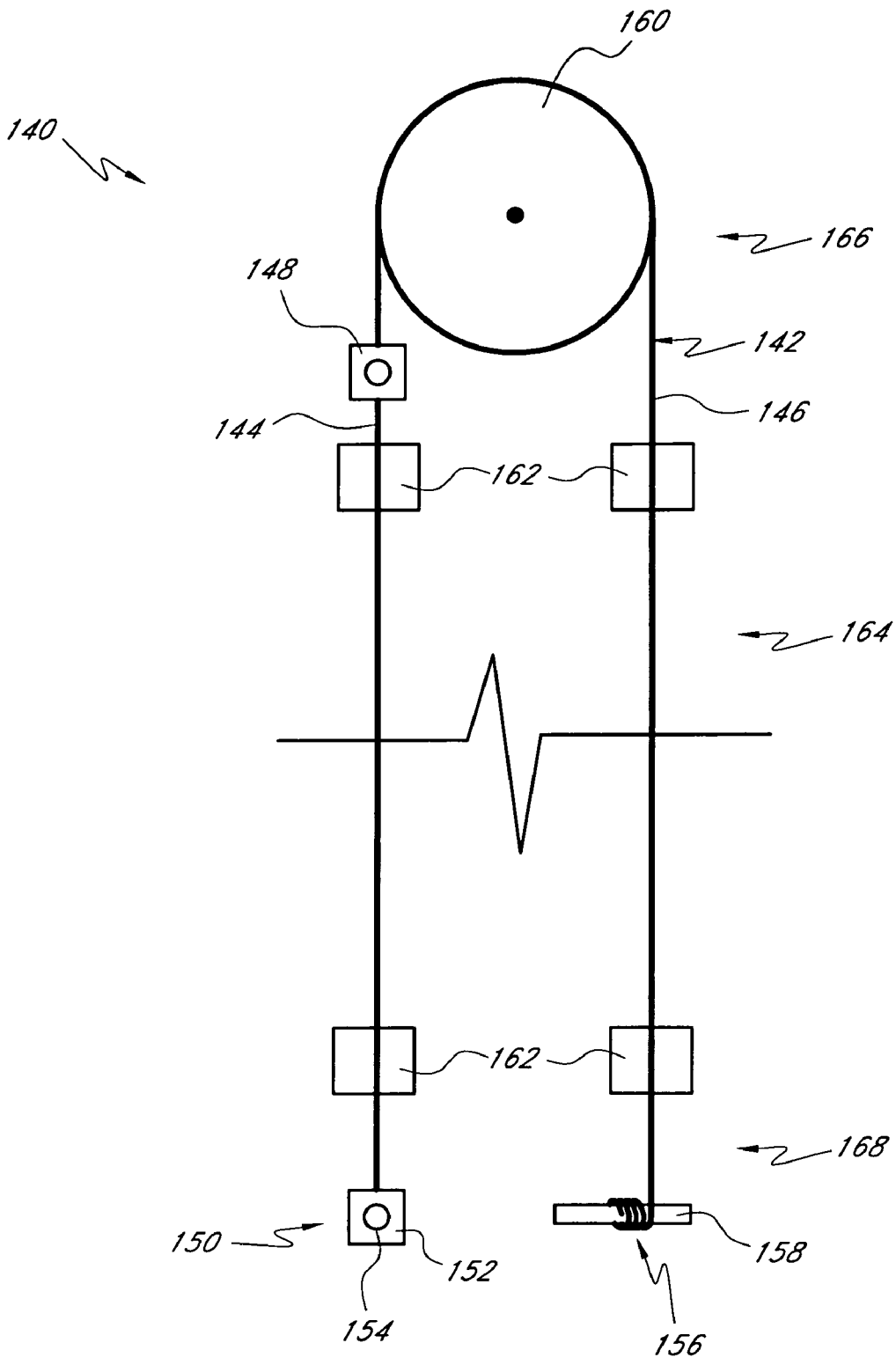
FIG. 6 schematically illustrates a musical string mounting arrangement in accordance with another embodiment.

With reference next to FIG. 6, still another embodiment of a musical string mounting system 140 is provided. As shown, the string mounting system 140 comprises an elongate composite musical string 142 comprising first and second string segments 144, 146 that are joined end-to-end at a connector 148, preferably in a manner as discussed above in connection with FIGS. 4 and 5. A first end 150 of the composite musical string 142 comprises a connector 152 that is affixed to an anchor 154 of the associated musical instrument. A second end 156 of the musical string 142 is attached to a tensioner 158 that is also anchored to the musical instrument, and which is adapted to selectively tighten the string 142. The elongate musical string 142 is wrapped about a pivot 160 which, in the illustrated embodiment, comprises a rotating pulley. Separators 162 are provided to vibrationally separate a playing zone 164 of the string 142 from first and second mounting zones 166, 168 and to establish the effective length of the portion of each associated string segment 144, 146 in the playing zone 164. Preferably, the connector 148 between the first and second segments 144, 146 is arranged in a mounting zone 166 so as not to interfere with or affect vibration of the string in the playing zone 164. In the illustrated embodiment, the separators 162 are shown schematically. It is to be understood that they may structurally resemble the separator portions 70 as described above in connection with FIG. 2, or may have a different type of structure, so long as they communicate tension across the separator 162 but substantially isolate vibrations from crossing the separator.

In the embodiment illustrated in FIG. 6, the first and second string segments 144, 146 preferably have different densities and/or other properties. As such, even though they are at substantially the same tension, the string segments 144, 146 will vibrate at different frequencies and, thus, emit different musical notes. In additional embodiments, the principles illustrated in FIG. 6 may be applied to additional segments. For example, additional pivots may be added in the mounting zones 166, 168, and additional string segments may be joined end-to-end by connectors to create a musical string system having as many segments as desired. The string segments preferably will zigzag back and forth, establishing a playing zone with several string segments. Preferably, each of the string segments employs a string having a different density, but the pivots, separators, anchors, and the like are configured so that the tension is substantially uniform throughout the string.

Figure 6A:
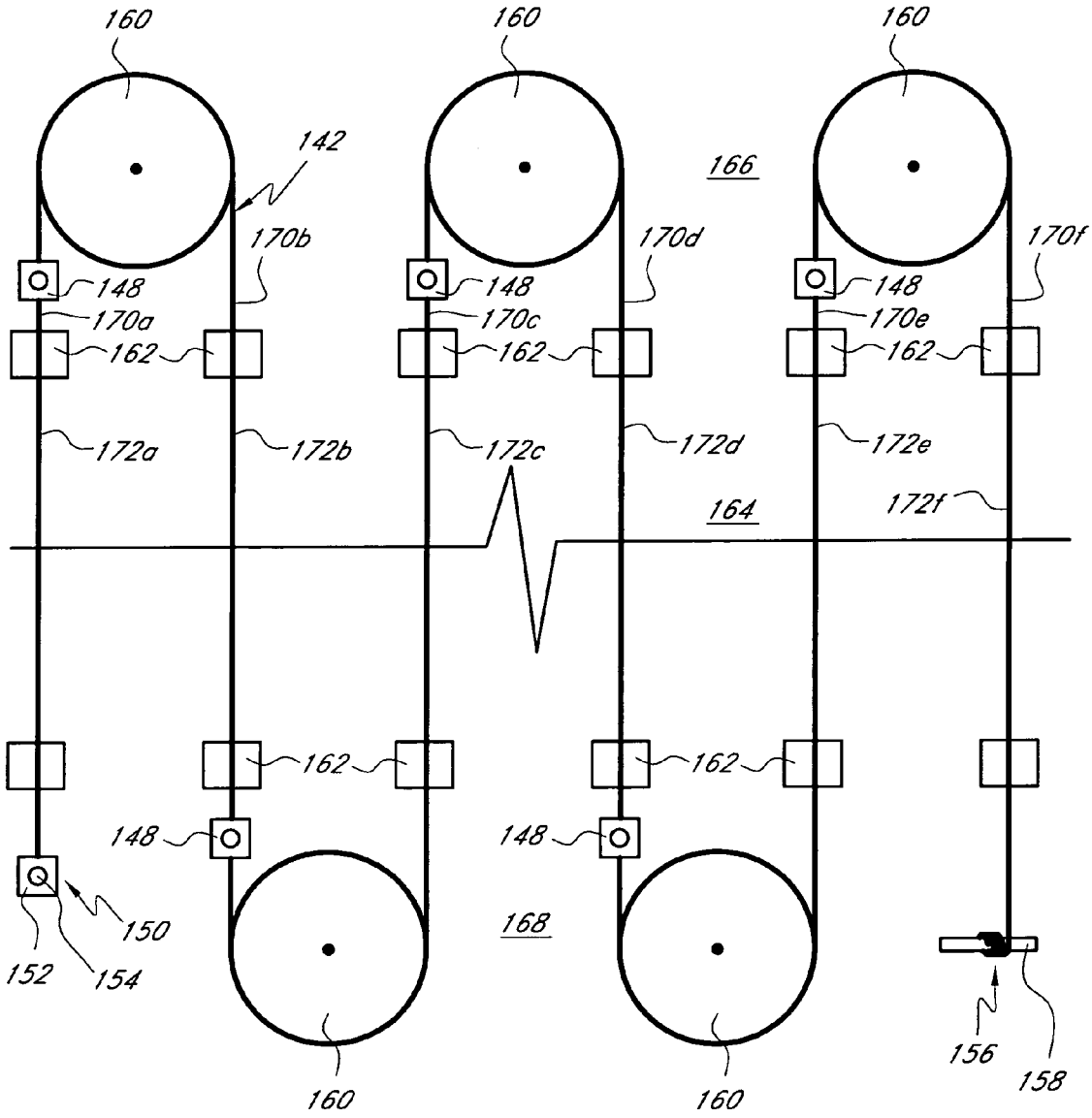
FIG. 6*a* schematically illustrates a musical string mounting arrangement in accordance with yet another embodiment.

For example, with reference next to FIGS. 3 and 6A, the principles discussed in connection with FIG. 6 can be applied to a guitar having a single composite musical string 142 having six string segments 170*a-f* that are joined end-to-end. Preferably, the multi-segment composite musical string 142 zigzags back and forth between pivots 160 so as to create six string portions 172*a-f* in the playing zone 164. Each of the playing zone string portions 172*a-f* preferably corresponds to a segment 170*a-f* of the composite musical string 142. Preferably, the six string segments 170*a-f* each have a different density, but are held at generally the same tension.

Preferably, the density and/or other properties of adjoining string segments is chosen so as to accommodate a desired relative tune between adjacent string portions. For example, in the embodiment illustrated in FIG. 6A the second string portion 172*b* density is selected so that when at the same tension and effective length as the first string portion 172*a*, it will vibrate at a frequency that emits a musical note that is five half steps higher than the note emitted by the first string portion 172*a*. Similarly, the third string portion 172*c* has a density selected to emit a note five half steps higher than the second portion 172*b*; the fourth portion 172*d* has a density selected to emit a note five half steps higher than the third portion 172*c*; the fifth portion 172*e* has a density selected to emit a note four half steps higher than the musical note emitted by the fourth string portion 172*d*; and the sixth string portion 172*f* has a density selected to emit a musical note five half steps higher than that of the fifth string portion 172*e*. As such, this embodiment is particularly useful for a guitar, which employs such relative tuning between the strings. Of course, in other embodiments, different relative tuning arrangements may be employed as desired.

In the embodiment just discussed, all of the string portions 172*a-f* are in relative tune to one another, regardless of the overall pitch of the strings. As discussed above, the first, or bass, string of a guitar typically is tuned to E, and the rest of the strings are tuned relative to the first string. Such can be the case in the illustrated embodiment. If the string is tightened so that the first string portion 172*a* emits an E, then all of the strings portions 172*a-f* are in relative tune (and conventional tune) to the first string portion 172*a*, and thus all string portions of the guitar are tuned quickly and easily by tuning only one of the portions. If a musician wishes to change the pitch of the guitar, the musician may simply increase the tension of the composite musical string 142. As tension increases, all of the string portions 172*a-f* simultaneously increase in tension, and thus emit a higher musical note. However, the string portions will remain in relative tune, with the same number of half steps between notes emitted by the string portions 172*a-f*. Thus, to increase the pitch of his guitar, the musician simply tightens the tension on the string 142, simultaneously increasing the pitch of the strings, yet maintaining the instrument in relative tune.

The embodiment discussed above in connection with FIG. 6A comprises an instrument employing a single composite musical string 142 comprised of six string segments 170*a-f* that correspond to six string portions 172*a-f* in the playing zone 164. In other embodiments, a musical instrument may employ more than one composite string. For example, the principles discussed above in connection with FIGS. 6 and 6A can be employed to create a guitar having, for instance, two composite musical strings that operate substantially independently, and which each comprise three string segments. Alternatively, a guitar may comprise three composite musical strings, wherein each composite string comprises two string segments. As such, a string mounting system employing principles as discussed herein may employ one, two, three or more string subsystems that may not be directly linked to one another. In other embodiments, as will be described below, string subsystems may be linked together in a musical string mounting system.

Figure 7:
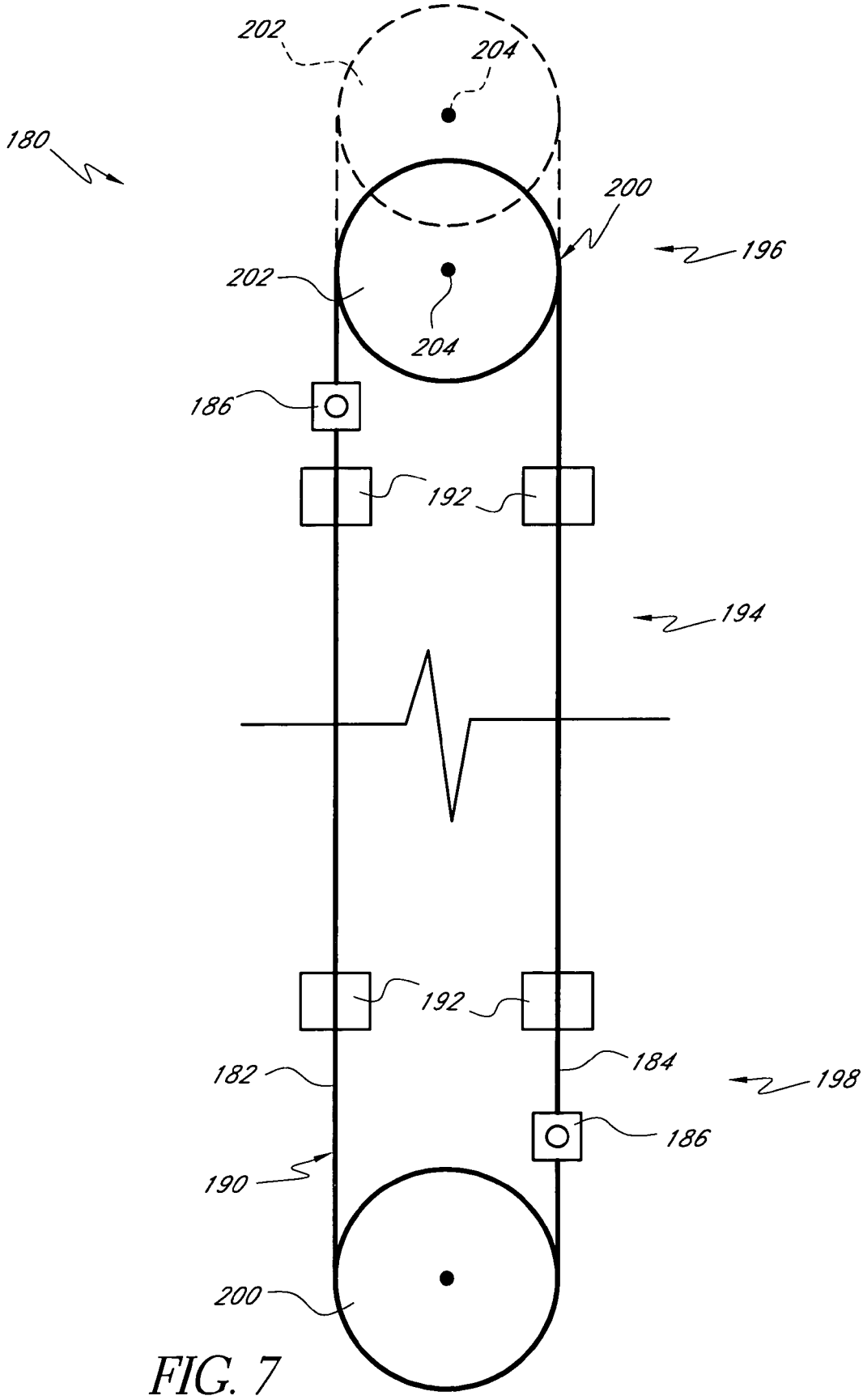
FIG. 7 schematically illustrates a further embodiment of a musical string mounting arrangement.

With reference next to FIG. 7, another embodiment of a musical string mounting system 180 is provided. In the illustrated embodiment, first and second string segments 182, 184 are joined end-to-end at connectors 186 in order to form a single continuous looped composite string 190. As in other embodiments, vibration separators 192 are provided to define a playing zone 194 and first and second mounting zones 196, 198, and the segments 182, 184 are wrapped about rotating pulleys 200 that function as tension-communicating pivots so that tension throughout the continuous string 190 is substantially the same. Preferably, the first and second string segments 182, 184 have different densities so that the segments emit different musical notes in a desired relative tune.

In the illustrated embodiment, a first one of the pulleys 202 is linearly movable. More specifically, preferably an axis 204 of the first pulley 202 is mounted on a track or the like so that the pulley 202 can be selectively linearly moved. When the pulley 202 is moved outwardly, away from the playing zone 194, the tension in the composite string 190 is increased, and vice versa.

Figure 8:
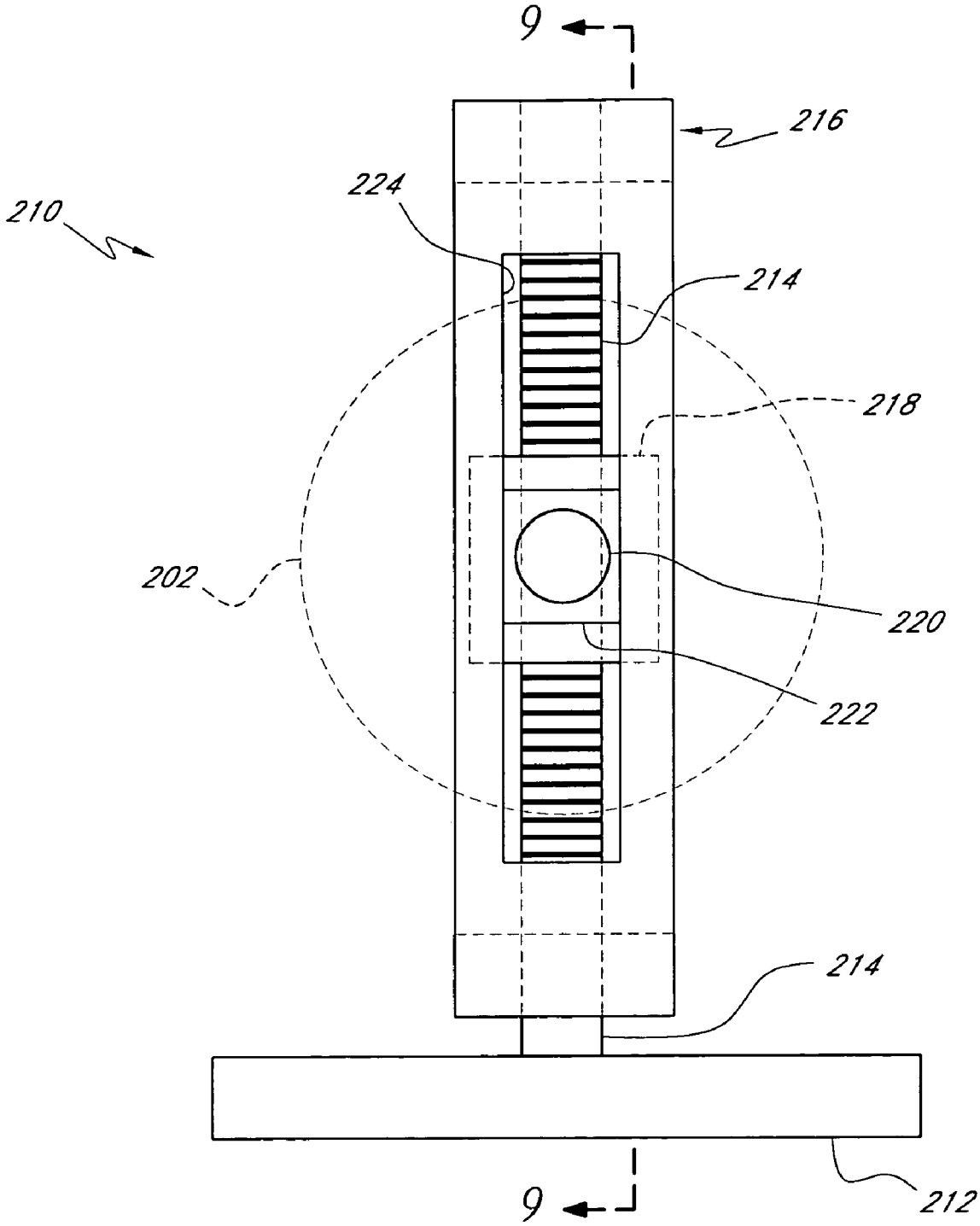
FIG. 8 is a top view of a device for linearly adjusting the position of a movable pulley from the embodiment of FIG. 7.
Figure 9:
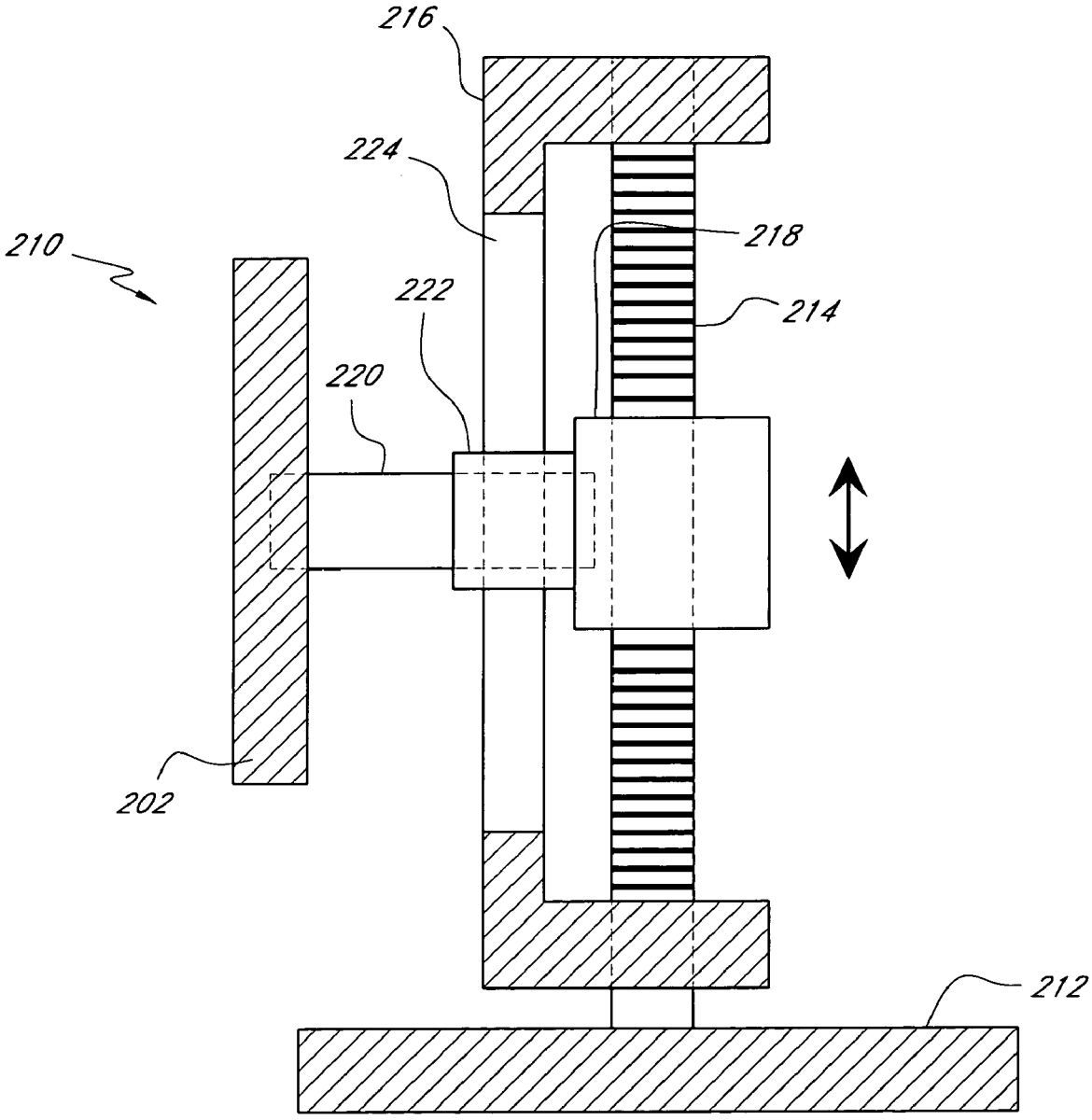
FIG. 9 is a cross sectional side view of the device of FIG. 8 taken along line 9-9.

With additional reference to FIGS. 8 and 9, an embodiment of a linear motion device 210 is presented. The illustrated linear motion device 210 is adapted to be mounted on a musical instrument so as to provide selective linear motion as discussed above in connection with FIG. 7. In the illustrated embodiment, the device 210 comprises a tuning key or handle 212 that is attached to an externally threaded rod or screw 214. The handle 212 and rod 214 preferably are mounted in a bracket 216 which is mounted to the musical instrument. An internally threaded block 218 is threaded onto the rod 214. The block 218 comprises a connecting rod 220 and a bushing 222. The bracket 216 further includes an elongate slot 224 through which the connecting rod 220 and bushing 222 fit. Accordingly, as the handle 212 and threaded rod 214 are rotated, the block 218, and accompanying connecting rod 220 and bushing 222, are moved linearly along the rod 214 within the slot 224. Preferably, the first pulley 202 of an embodiment, such as the embodiment shown in FIG. 7, is attached to the connecting rod 220 so that the connecting rod 220 functions as the axle 204 for the first pulley 202.

It is to be understood that other suitable structures may be employed for linearly moving the pulley axle 204. For example, in another embodiment, a rack and pinion-type gearing arrangement may be employed. Further, it is contemplated that other structures, including structures that may employ ratcheting or the like, may be suitably used.

Figure 10:
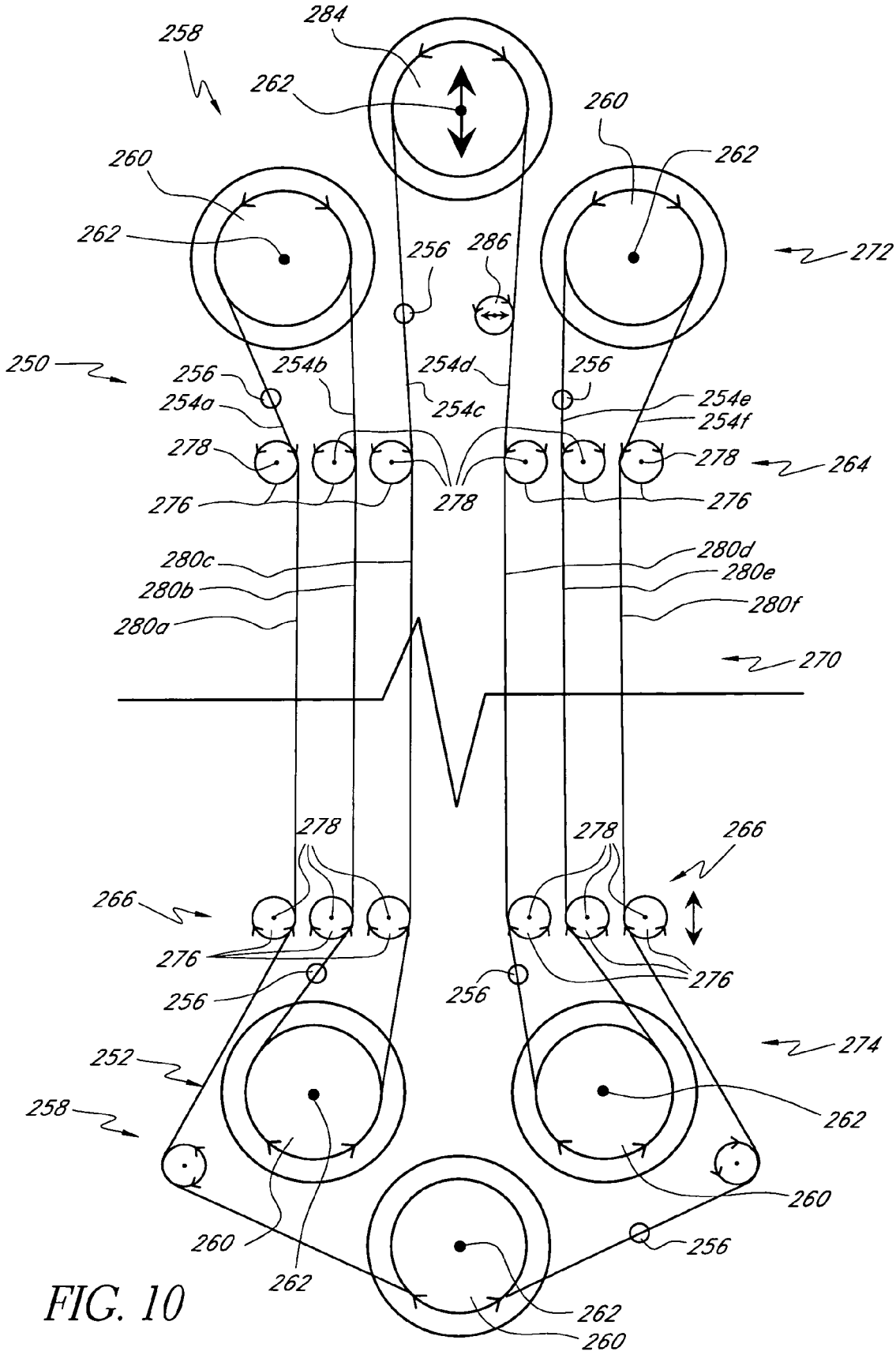
FIG. 10 illustrates still a further embodiment of a musical string mounting arrangement.

With reference next to FIG. 10, yet another embodiment of a musical string mounting arrangement 250 is illustrated. The illustrated embodiment comprises a single composite string 252 made up of six string segments 254 *a-f* that are joined end-to-end by connectors 256. The illustrated composite string 252 is connected to itself to form a continuous loop. Specifically, a first segment 254*a* is joined end-to-end with a second segment 254*b*, which is joined end-to-end with a third segment 254*c*, which is joined end-to-end with a fourth segment 254*d*, which is joined end-to-end with a fifth segment 254*e*, which is joined end-to-end with a sixth segment 254*f*, which is joined end-to-end with the first segment 254*a*.

The composite string 252 is routed through an array 258 of rotatable pulleys 260 that function to maintain a substantially uniform tension distributed throughout the composite string 252. Each pulley 260 preferably rotates about an axis 262. A first set 264 and a second set 266 of vibration separators are provided to define a playing zone 270 that is vibrationally separated from first and second mounting zones 272, 274. In the illustrated embodiment, each of the vibration separators 266 comprises a substantially cylindrical body 276 that is adapted to rotate about a generally vertical axis 278. It is contemplated, however, that other structures may be used as desired for vibration separators. Additionally, the illustrated string mounting system 250 includes six string portions 280*a-f* in the playing zone 270, and is thus especially suitable for use on a guitar as in the embodiment of FIG. 3. It is to be understood that spacing between the string portions 280*a-f* can be adjusted as desired so that the string portions 280*a-f* in the playing zone 280*a-f* are uniformly spaced from one another, or are arranged in any other desired arrangement.

In the embodiment illustrated in FIG. 10, one of the pulleys is a tension adjustment pulley 284. Preferably, the tension adjustment pulley 284 is linearly movable relative to the other pulleys 260 so as to simultaneously increase or decrease the tension, and thus the pitch, of all of the string portions 280*a-f*. In the illustrated embodiment, the tension adjustment pulley 284 is linearly movable by any suitable structure, such as the structure 210 discussed above in connection with FIGS. 8 and 9.

Preferably, the tension adjustment pulley 284 provides a macro, or rough, tuning adjustment to allow a musician to quickly tune the string system 250 at or very near a desired tuning pitch. In the illustrated embodiment, a fine tuning member 286 is also provided. The illustrated fine tuning member 286 comprises a rotatable pulley that engages the composite string 252, and which is linearly and incrementally movable into and out of engagement with the string 252 so as to selectively deflect the string 252, thus increasing or decreasing tension in the string 252.

Preferably, the fine adjustment pulley 286 is smaller than the macro adjustment pulley 284, and generally is less engaged with the string 252 than is the macro adjustment pulley 284. For example, in the illustrated embodiment the string 252 is wound about 180 degrees of the macro adjustment pulley 284, but the fine tuning adjustment pulley 286 makes less contact with the musical string 252. As such, linear movement of the fine tuning adjustment pulley 286 has less of an effect on string tension than does the same amount of linear movement of the macro adjustment pulley 284. Accordingly, after a rough tuning has been achieved a musician may use the fine tuning pulley 286 to dial in a perfect tune of the instrument more easily than can be accomplished with the macro adjustment pulley 284. Of course, in additional embodiments, only a single adjustment pulley may be employed.

When low-quality or even typical-quality musical strings are employed, it is anticipated that there will be significant manufacturing variations in the density of string segments. For example, the density of a string segment may not be tightly controlled during manufacturing, resulting in variations in the actual vibration frequency of the string at a specified tension. Thus, string segments may not emit the exact tone anticipated at a specified string tension and length. Potentially, due to such variations, the string segments may not be in a desired relative tune when all are held at the same tension; however, they likely will be quite close to relative tune.

With continued reference to FIG. 10, in one embodiment, the vibration separators 266 adjacent the second mounting zone 274 preferably are selectively linearly movable. Preferably, each such vibration separator 266 is independently movable. In an embodiment suitable for use on a guitar, a range of movement of about ½-2 inches, or more preferably about 1 inch, is provided. Other instruments may also include such ranges of movement, depending on the density and length of the strings. In additional embodiments, vibration separators 264, 266 on both sides of the playing zone 270 may be linearly movable. However, in instruments wherein the effective length of the strings in the playing zone is shortened by the musician's fingerwork (such as guitars, violins, and the like), preferably only the vibration separators on the instrument body (such as the bridge of a guitar) are movable.

Movable vibration separators may employ adjustment structure similar to the device discussed above in connection with FIGS. 8 and 9, but may also employ other structures. Examples of acceptable structures include, without limitation, incremental peg and hole arrangements, a slide with or without detents, a slide and clamp arrangement, ratcheting gear, or any other suitable structure.

In another embodiment, the linearly movable pulley 284 is connected to a spring member so that the pulley is biased toward tightening the string 252 (away from the playing zone 270 in the arrangement illustrated in FIG. 10). Preferably, a first end of the spring is attached to the instrument and a second end is attached to the pulley 284. Most preferably, the spring has a spring constant chosen so that the spring exerts a relatively constant force over a short range of deflection. Thus, even if the string 252 stretches or elongates over time, the spring takes up the slack and applies a relatively constant tension to the string 252 so that the emitted tone does not audibly change.

Applicant has noted that a relatively small "stretch" of a musical string on a typical guitar may cause reduced string tension that results in the string segment going out of tune. For example, elongation of a musical string even by less than ⅛ inch may cause an audible change in its tone. Thus, preferably the spring is chosen to exert a relatively constant force over a displacement range of about ⅛ inch. A relatively constant force includes a range of forces over which there is no audible tone change in the associated string. Thus, in this embodiment, once the string is in tune, it will stay in tune even if it stretches a small amount. Also, this embodiment enables automatic tune of the instrument. For example, once the string 252 is tightened sufficient to engage the spring within the range of constant force, the spring will ensure correct string tension.

In another embodiment, the second end of the spring is attached to an adjustment member, so that by actuating the adjustment member, the linear displacement of the spring can be varied significantly and, thus, the force/tension that the spring exerts on the string can be adjusted by adjusting the spring displacement.

The principle discussed above can also be employed in connection with other embodiments. For example, each individual string of a multi-string musical instrument could include a spring-loaded string mount. Also, a first end of a multi-segment musical string could be attached to a spring-loaded string mount, or both ends of such a string could be attached to a spring-loaded string mount.

Figure 11:
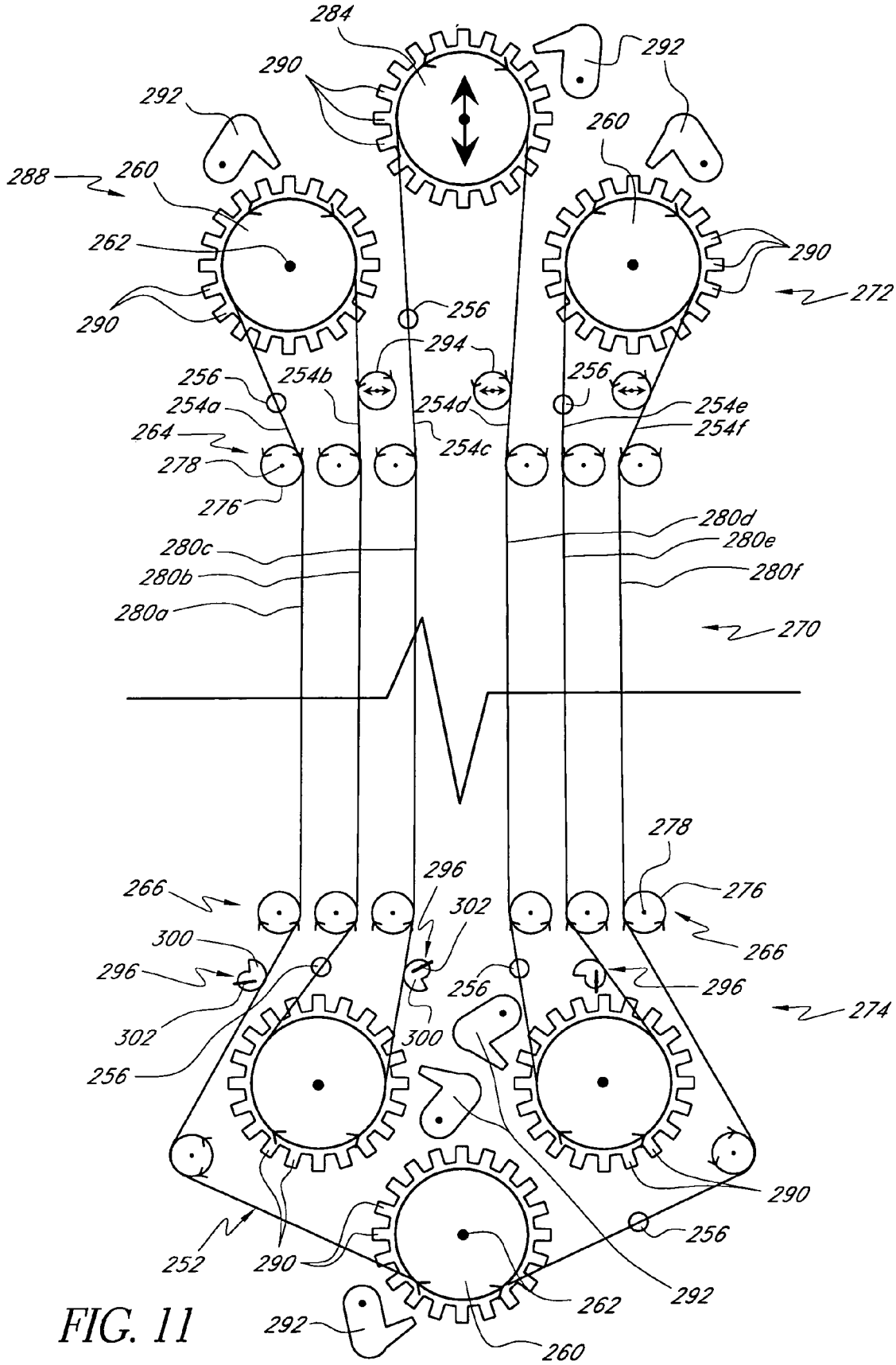
FIG. 11 shows yet another embodiment of a musical string mounting arrangement enabling fine-tuning of each string portion.

With reference next to FIG. 11, yet another embodiment of a musical string mounting system 288 is provided. The illustrated embodiment shares many structural points and advantages with the embodiment 250 discussed above in connection with FIG. 10, including the continuous looped composite musical string 252 and the macro tuning adjustment pulley 284. However, in this embodiment, preferably each of the string pulleys 260 may selectively be locked in place so as to not rotate and, correspondingly, to no longer communicate tension across the pulley.

In the illustrated embodiment, each of the pulleys 260, 284 comprises an outer periphery having teeth 290. The teeth 290 preferably are arranged so as to not interfere with the string 252 on the pulley 260, 284. A latch 292 is provided adjacent each pulley, and is adapted to selectively engage the teeth 290 so as to prevent the pulley 260, 284 from rotating. Preferably, the latch 292 is spring loaded so that, once triggered, it will stay in place. Fine tuning members 294, 296 are provided at or adjacent each tensioned string segment 254*a-f* between pulleys 260, 284. A first type of fine tuning member 294 closely resembles the fine tuning pulley 286 discussed above in connection with FIG. 9. A second type of fine tuning member 296 is constructed in accordance with another embodiment. More specifically, the second fine tuning members 296 each comprise a cam 300 rotatably mounted upon an axle 302 and adapted to engage and deflect an associated string segment 254*a-f*. The cam 300 may be rotated in order to increase or decrease deflection of the associated string segment 254*a-f*, and thus correspondingly increase or decrease the tension in the associated string portion 280*a-f*.

In the illustrated embodiment, the string system 288 is first drawn to a desired tension by the adjustment pulley 284 so as to tune a desired one of the string portions 180*a*, such as, for example, the low E string of a guitar. Preferably, the other string portions 180*a-f* are adapted to be appropriately tuned to the other strings of a typical guitar, but due to manufacturing variations, such as wide tolerances, may not be precisely in appropriate relative tune at the tension at which the low E string segment is in tune. The latches 292 are then triggered to maintain each of the string portions 280*a-f* in its macro tuned tension, and to vibrationally and tensionally isolate the string portions 280*a-f* between the pulleys 260, 284 from one another. Preferably, the pulleys have a relatively high friction surface so that the string 252 does not move across the pulleys, and thus tension is not communicated across the pulleys 260, 284 when they are prevented from rotating. The musician then adjusts the fine tuning members 294, 296 to vary the tension in the string portions 280*a-f* as needed to fine tune each string portion as desired to ensure correct relative tune.

It is to be understood that other structural arrangements may be employed to accomplish the purposes described above in connection with FIG. 11. For example, for ease of use a single latching mechanism may be adapted to simultaneously engage all three pulleys 260 in one of the mount zones 272, 274. Additionally, multiple pulley-engaging latches may be provided in each of the mount zones, and may be linked together so as to be selectively actuable by a single button, switch or the like. In yet another embodiment, a mount zone gear is adapted to engage teeth of a plurality of pulleys, and thus rotates with pulleys. A latch, stop or other stopping mechanism is provided for engaging the mount zone gear so as to selectively restrain rotation of the mount zone gear, and thus selectively restrain rotation of the pulleys that are engaged with the mount zone gear. One or more mount zone gears may be provided in each mount zone 272, 274, and may operate independently or, as desired, may be linked so as to act in concert. For example, a chain, belt, or the like may extend between mount zone gears so that the mount zone gears, and thus the pulleys, all rotate in concert or are prevented from rotation in concert. In some embodiments, mount zone gears located in mount zones 272, 274 on opposite sides of the playing zone 270 may be so linked. Preferably, any structure in which the pulleys may rotate freely, but may selectively be locked in place so as to not rotate, may be employed.

In the embodiments discussed above in connection with FIG. 11, the pulleys 260, 284 have a first disposition, in which they rotate and function as tension-communicating pivots, and a second disposition in which they do not rotate, but function as pivots that do not communicate tension. When in the first disposition, the musician adjusts tension to achieve a macro, or rough, tuning of all of the string portions 280*a-f* simultaneously. The musician then actuates a stopping mechanism, by actuating one or more trigger buttons or manually actuating latches 292 or the like, in order to switch the string system 288 to the second disposition. When the system is in the second disposition, the musician can fine tune the tension of each string portion 280*a-f* individually.

The embodiment illustrated in FIG. 11 shows two different embodiments of a fine tuning device 294, 296. It is to be understood that the first type of device 294, the second type of device 296, or combinations of such devices can be used. It is also to be understood that other structures that facilitate changing the tension in a string portion may be used.

Preferably, the cam type fine tuning members 296 have a neutral position at which the cam is capable of either increasing or decreasing string tension. For example, in the embodiment illustrated in FIG. 11, rotation of the cam device 300 clockwise will increase deflection of the associated string portion 280 and thus increase string tension, but rotation of the cam 300 in a counterclockwise direction will reduce deflection of the associated string portion 280 and thus reduce tension. In one embodiment, the cam type fine tuning member 296 are spring loaded so that upon actuation of a button, switch, or the like, the cam members 300 return to their neutral position.

Figure 12A:
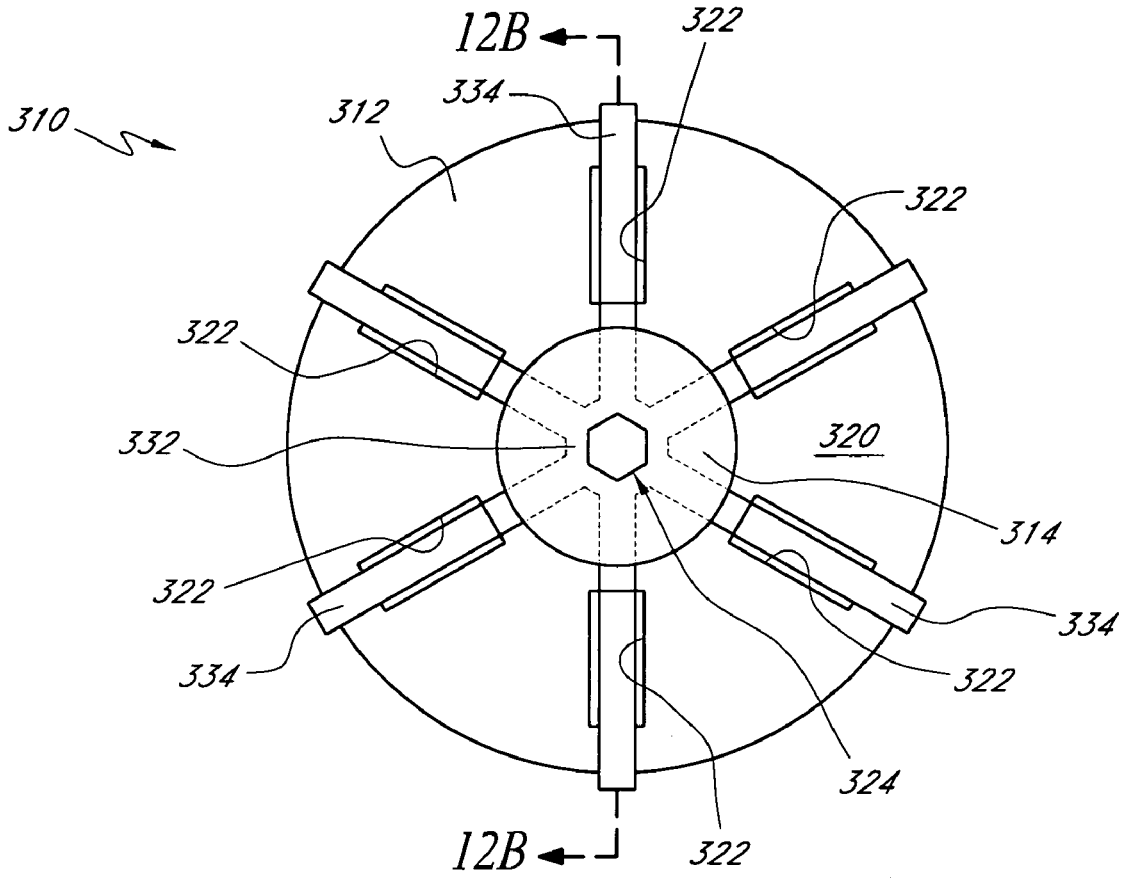
FIG. 12*a* shows an embodiment of an irising tension adjustment pulley.

With reference next to FIGS. 12*a* and *b*, another embodiment of a tension adjustment pulley 310 is illustrated. In the illustrated embodiment, the tension adjustment pulley 310 is a "iris" type pulley, in which the effective diameter of the pulley may be adjusted. More specifically, as the effective diameter of the pulley is increased, tension in the musical string is correspondingly increased. As the pulley's effective diameter is decreased, tension correspondingly decreases.

The tension adjustment pulley 310 illustrated in FIGS. 12*a* and *b* comprises a substantially conical pulley member 312 having a top 314, a bottom 316, and an engagement surface 320. Preferably, the top 314 is flat so that the pulley member 312 is a partial cone. Preferably, the pulley member 312 is rotatably mounted on the associated musical instrument. Elongate slots 322 are formed through the surface 320. An elongate bolt 324 extends downwardly from the top 314 of the pulley member 312 and engages a string guide 330. The string guide 330 includes a nut portion 332 which is internally threaded so as to engage the threads of the bolt 322. A plurality of arms 334 extend radially outward from the nut 332, and extend through corresponding elongate slots 322 through the surface 320. Each arm 334 preferably includes a top portion 336 and a bottom portion 338 that are spaced apart a distance at least equal to the diameter of a musical string.

In operation, as the bolt 324 is rotated, the bolt threads engage the nut threads so as to linearly move the nut and associated arms 334 upwardly and downwardly. A string seat 340 is defined between the top and bottom arm portions 336, 338 and at the surface 320 of the pulley member 312. The location of the string seat 340 changes as the arms 334 are moved up and down over the surface 320 of the pulley 312. The effective diameter of the tension adjustment pulley 310 is defined by the diameter of the pulley member 312 at the string seat 340. As the bolt 324 is rotated to move the string holder device 330 upwardly, the effective diameter of the pulley member 312 is decreased, and vice versa.

An irising tension adjustment pulley 310 such as the embodiment discussed above in connection with FIGS. 12*a* and *b* may accomplish a tension adjustment as does the tension adjustment pulley 284 of FIG. 10, but without requiring a linear motion mechanism. Accordingly, in additional embodiments, an irising tension adjustment pulley 310 may be used in place of, or in addition to, a linearly movable tension adjustment pulley 284. Further, it is anticipated that irising-type tension adjustment pulleys having construction other than the specific structure shown in the embodiment discussed above may be employed.

Figure 13A:
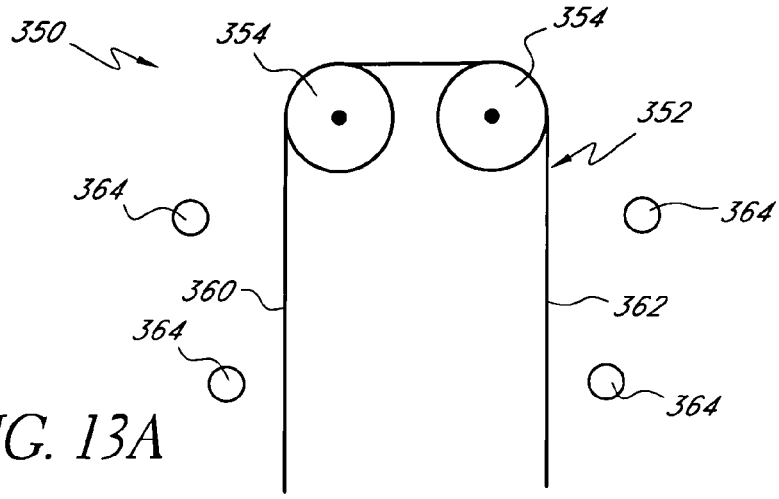
FIGS. 13*a-c* illustrate yet another embodiment of a string mounting system having a structure for fine tuning strings, shown in different arrangements.

With reference next to FIGS. 1 and 13*a-c*, another embodiment of a musical string mounting arrangement 350 is provided. This embodiment also enables adjustments in order to fine tune the stringed instrument. For example, FIG. 13*a* shows an embodiment wherein a musical string 352 is drawn across a pair of pulleys 354 and is held at a first tension. The first and second string segments 360, 362 of the string 352 follow a default path. A plurality of pegs 364 preferably are provided adjacent to but spaced from the default path of the string.

Figure 13B:
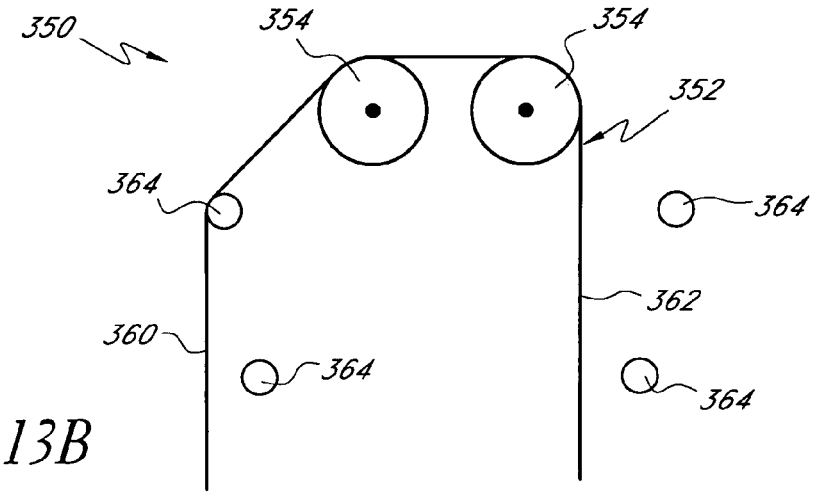
Figure 13C:
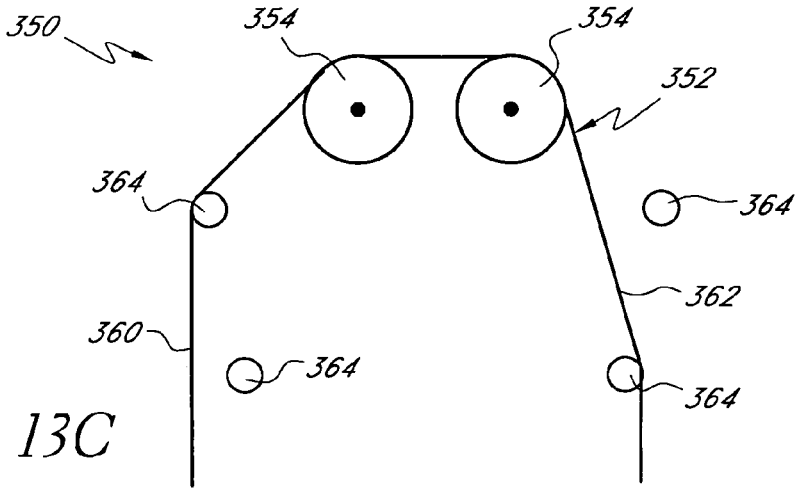

FIG. 13*b* illustrates an embodiment in which the first string segment 360 is drawn about one of the pegs 364. In this embodiment, the string 360 is deflected from its default path, and the path is lengthened, thus increasing the tension of the string 352. FIG. 13*c* illustrates a still further arrangement in which the second string segment 362 is engaged with still another peg 364, yet further increasing the string tension. In yet a further arrangement, a string segment may engage a plurality of pegs 364.

In the arrangements illustrated in FIGS. 13*a-c*, the pegs 364 also function as vibration separators. Further, depending on which peg, if any, the string 352 is routed about, the effective vibrating length of the string segment 360, 362 is shortened, thus changing the natural frequency of vibration of the musical string in at least that segment. Thus, as in the arrangement illustrated in FIG. 12*c*, although the tension in the string 352 is uniform on both sides of the pulleys, the effective length of the string segment 360, 362 is shorter on one side than the other, resulting in different natural frequencies. In another embodiment, the pegs 364 may be disposed in a mounting zone, and vibration separators may be provided so that routing the string 352 across pegs 364 does not affect the effective length of the string segment 360, 362. In further additional embodiments, the pulleys 354 may be selectively stopped from rotating in order to tensionally isolate one string segment from the other, and then the string segments may be routed about pegs 364 in order to separately fine tune each string segment 360, 362 at a desired tension.

In the illustrated embodiment, the pegs 364 are fixedly mounted to the musical instrument. In another embodiment, an array of detents or holes are provided on the instrument, and pegs are removably fit into the holes. In a still further embodiment, the pegs 364 are retractable, and remain in a retracted state within the musical instrument until selectively deployed as desired by the user. Such retractable pegs may be spring loaded for easy deployment. Still further embodiments may employ pegs having a surface treatment with a substantially high polish and/or a coating such as a Teflon coating in order for the string to easily slide across the low friction surface of the peg, and thus communicate tension across both sides of the peg. Alternatively, pegs may have a high friction surface treatment and/or coating so as to resist movement of the string across the pegs and thus to not communicate tension across the peg.

Figure 14:
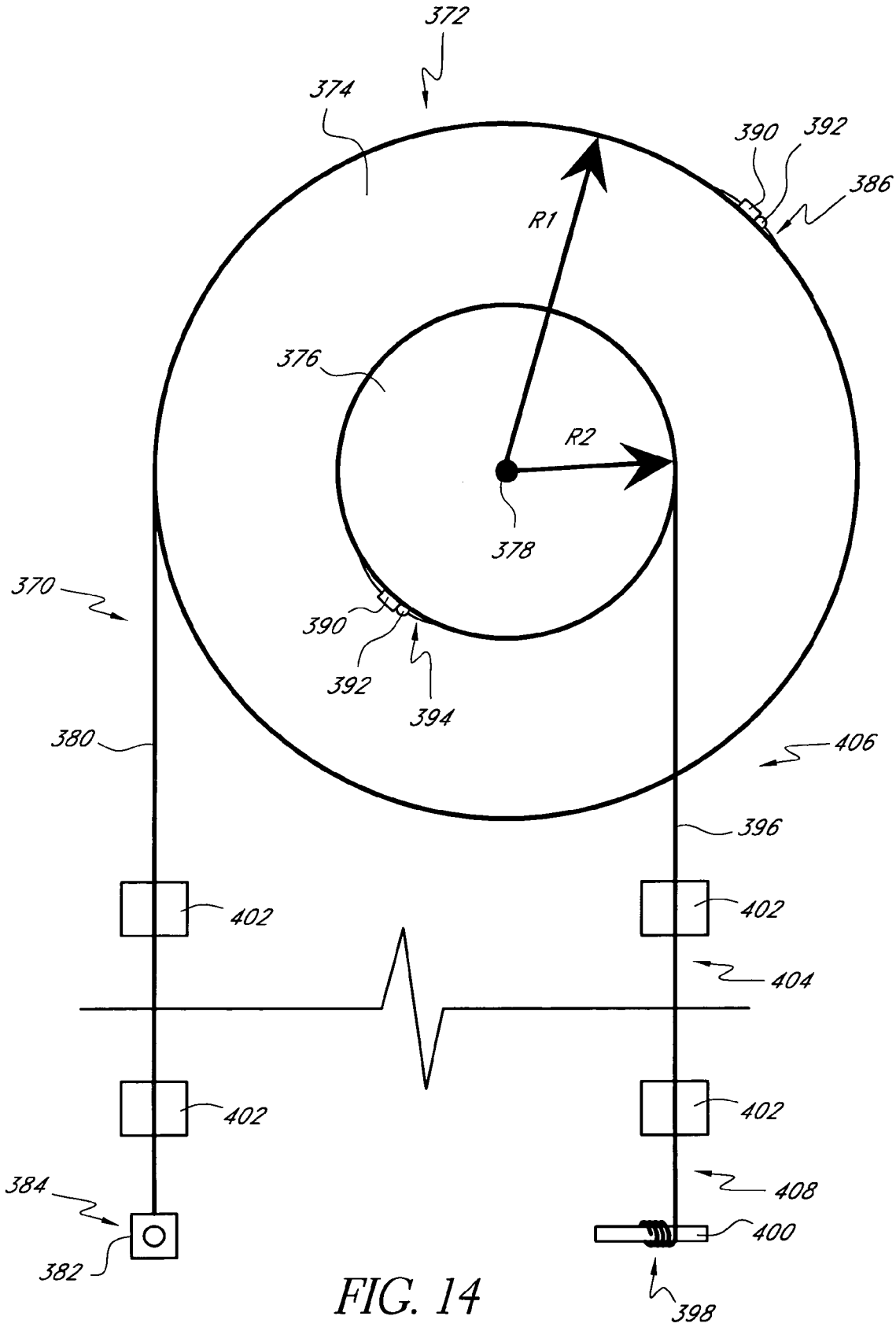
FIG. 14 illustrates a portion of another embodiment of a musical string mounting arrangement wherein adjacent string segments are secured at relative tensions.

With reference next to FIG. 14, another embodiment of a musical string mounting arrangement 370 is presented in which adjacent string portions are held and maintained at relative tensions during a tension adjustment. In the illustrated embodiment, a composite pulley 372 comprises a first pulley member 374 having a first radius $R_1$ and a second pulley member 376 having a second radius $R_2$. The pulley members 374, 376 are adapted to rotate together about an axis 378. A first string segment 380 preferably is connected to the musical instrument via a connector 382 on a first end 384 of the segment 380. A second end 386 of the first string segment 380 is connected to the first pulley member 374. Preferably, the string segment 380 is wrapped at least partially about the pulley member 374, and connector portions 390, 392 of the pulley 374 and string segment 380 engage one another. A first end 394 of a second string segment 396 is connected to the second pulley member 376. Preferably, the string segment 396 is wrapped at least partially about the pulley member 376, and connector portions 390, 392 of the pulley 376 and string segment 396 engage one another. A second end 398 of the second string segment 396 is connected to a tension adjustment knob or key 400 that is attached to the musical instrument. Preferably, vibration separators 402 are provided to define a playing zone 404 between first and second mounting zones 406, 408.

In the illustrated embodiment, the first radius $R_1$ is different from the second radius $R_2$. As such, when the tuning key 400 is twisted to increase or decrease the tension in the second string segment 396, tension will also be affected in the first string segment 380; however, the tension in the first and second string segments 380, 396 will differ in accordance with a relative relationship. More specifically, when the pulley 372 is at an equilibrium condition in which the composite pulley 372 does not rotate, each of the first and second string segments 380, 396 will be applying a force, or tension, sufficient to create a moment of inertia of equal and opposite magnitude on the pulley 372, and the tension in the string segments 380, 396 will be related to each other in accordance with the mathematical relationship $T_1R_1=T_2R_2$, where $T_1$ is the tension in the first string segment 380, $R_1$ is the radius of the first pulley member 374, $T_2$ is the tension in the second string segment 396, and $R_2$ is the radius of the second pulley member 376. As such, the tension in the string segments 380, 396 will always differ in accordance with a mathematical relationship based upon the relative radii of the pulley members 374, 376, for example, $T_1=(R_2/R_1)\,T_2$.

Figure 12B:
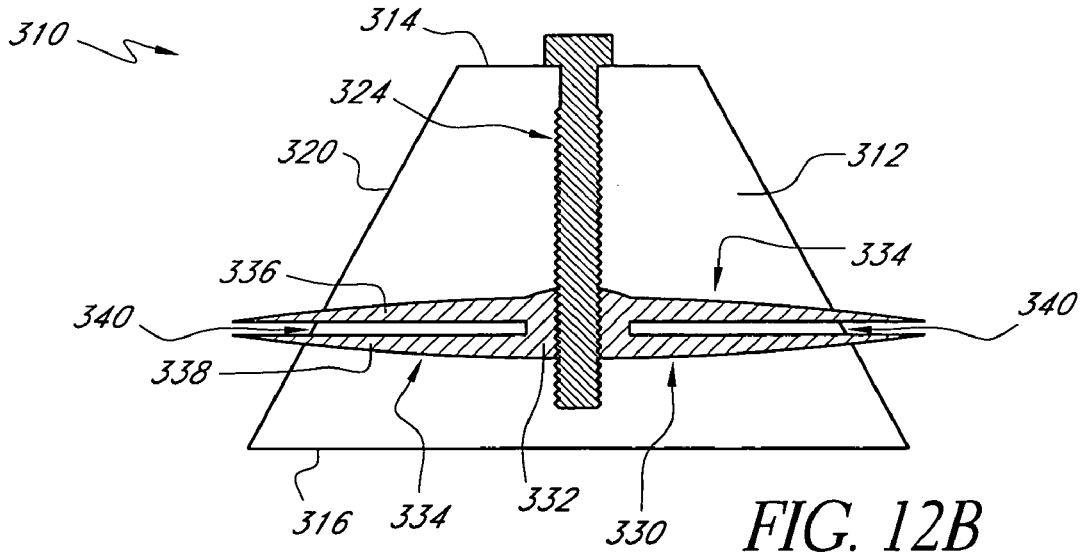
FIG. 12*b* is a cross section of the embodiment of FIG. 12*a* taken along line 12*b*-12*b*.

In another embodiment, a composite pulley is provided which, like the embodiment shown in FIG. 14, employs a first pulley member having a first radius. However, a second pulley member that rotates with the first pulley member preferably has a variable radius. For example, the second pulley member could employ "irising" structure as discussed above in connection with FIG. 12. As such, the tension relationship between adjacent string segments can be adjusted. Such an arrangement will allow for fine tuning the relative tuning relationships between string segments. Once the tuning relationship is appropriately adjusted, the pitch of the string segments can be simultaneously changed while maintaining the relative tune.

Figure 15:
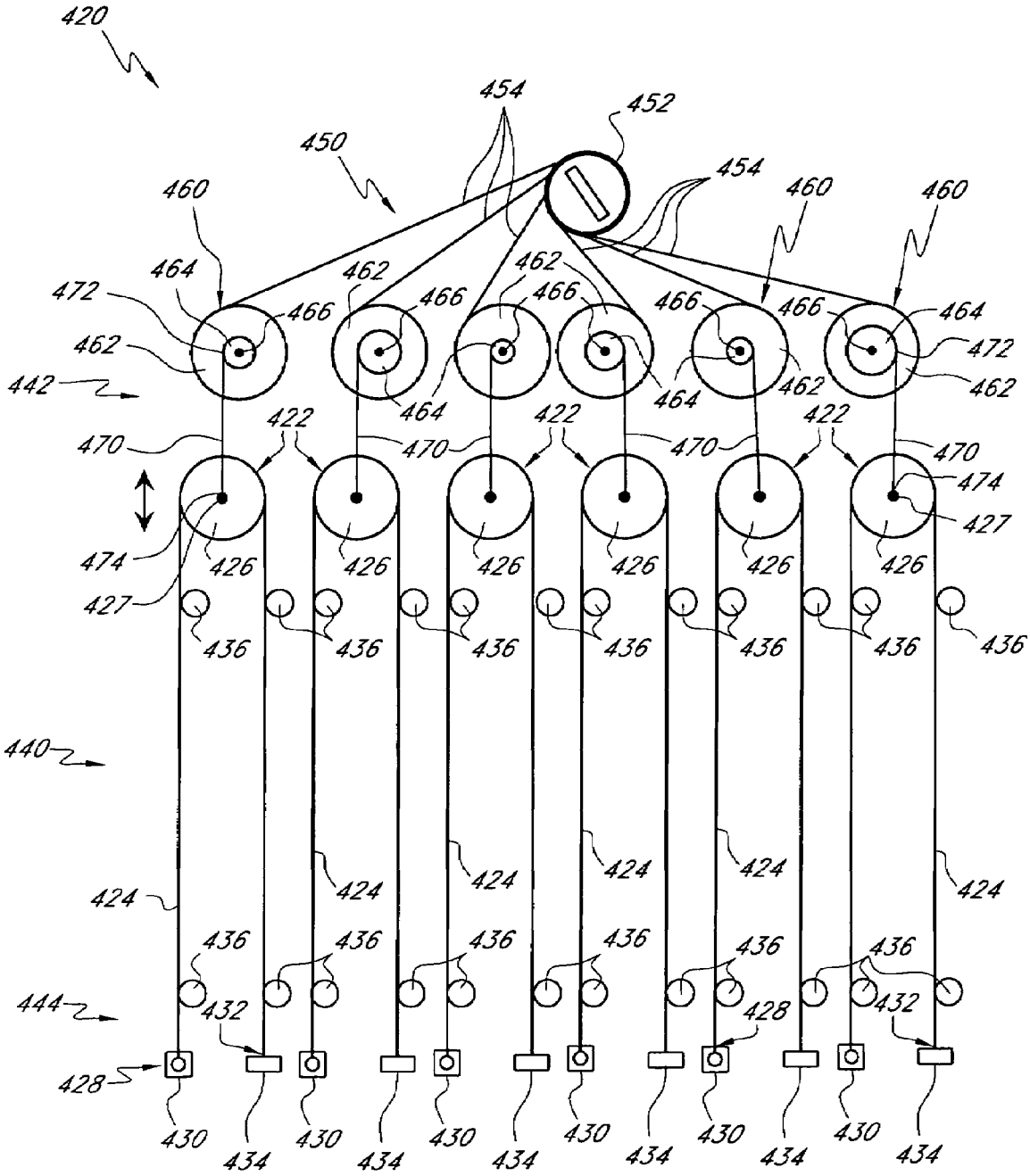
FIG. 15 illustrates an embodiment of a 12-string musical string mounting arrangement wherein string subsystems are maintained at relative tensions.

With reference next to FIG. 15, another embodiment of a musical string mounting arrangement 420 is illustrated. In this embodiment, a plurality of string subsystems 422 each comprise a musical string 424 routed about a linearly-movable pulley 426 having an axis 427. A first end 428 of each musical string 424 is anchored to the musical instrument at a connector 430; a second end 432 is attached to a tensioning device 434 such as a tuning key. Preferably, in each subsystem 422, vibration separators 436 define a playing zone 440 between first and second mount zones 442, 444. Each subsystem 422 preferably is independently tuned by use of the associated tensioning device 434.

A pitch adjustment system is adapted to increase or decrease the tension in each subsystem 422 simultaneously so as to change the pitch or key of the entire string system 420. The illustrated pitch adjustment system 450 comprises a pitch adjustment knob 452 about which a plurality of main adjustment wires 454 are at least partially wound.

A plurality of proportional adjustment pulleys 460 are provided, one proportional adjustment pulley 460 corresponding to each main adjustment wire 454. Each proportional adjustment pulley 460 preferably comprises first and second concentrically arranged pulley members 462, 464 that are adapted to rotate with one another about an axis 466. The main adjustment wire 454 attaches to the first pulley member 462. A dedicated linear movement line 470 is attached at a first end 472 to an associated second pulley member 464. A second end 474 of each dedicated linear movement string 470 is attached to the axis 427 of a corresponding subsystem pulley 426.

Preferably, each subsystem pulley 426 is linearly movable, preferably along a line substantially parallel to a longitudinal axis of the strings 424 in the playing zone 440 of the instrument. As such, when the proportional adjustment pulley 460 is rotated, the linear movement line 470 causes the subsystem pulley 426 to move linearly, thus stretching or relaxing the associated string 424. The string 424 associated with the pulley 426 is governed by the equation $F=-kx$, where F is the force, or tension, in the string, "x" is the linear displacement of the string, and "k" is the spring constant of the spring. As such, as the pulley 426 is moved linearly, the tension in the corresponding string 424 increases or decreases based upon the displacement and the spring constant of the string. Preferably, the proportional pulleys 460 are each dimensioned to consider such material properties in order to maintain correct relative tune between strings 424.

The main adjustment wire 454 and linear movement line 470 preferably are constructed of a material, such as wire, string, or the like, that can be wound about a pulley, but may also communicate tension along its length.

In the illustrated embodiment, the first pulley member 462 and second pulley member 466 of each proportional pulley 460 have different radii. As such, a mathematical proportional relationship between the radii of the pulley members 462, 464 determines the change in tension of the string 424 in the corresponding string subsystem 422 that occurs upon rotating the pitch adjustment knob 452. Preferably, the pitch adjustment knob 452 is constructed so that, upon rotation, each main adjustment wire 454 travels substantially the same linear distance. However, due to the differing radii of the proportional pulleys 462, 464 corresponding to each of the subsystems 422, such linear travel of the main adjustment wires 454 results in a different, specially-configured tension adjustment for each string subsystem 422. These relative adjustments are determined by the proportional relationships of the radii of each proportional adjustment pulley 460 in combination with other factors such as the spring constant of the respective strings. As such, the tension of each string subsystem 422 is adjusted by rotating the pitch adjustment knob 452, and such tension adjustments between string subsystems are mathematically related so that the relative tuning between string subsystems 422 remains governed by such mathematical relationships, and each string subsystem remains in relative tune with the other subsystems. Accordingly, the relative radii of the first and second pulley members 462, 464 of each proportional pulley 460 are preferably chosen in consideration of properties (such as density and spring constant) of the associated string subsystem 422. In summary, rotating the pitch adjustment knob 452 will simultaneously adjust the pitch of the entire group of string subsystems 422 while maintaining a desired relative tune between subsystems 422.

In the embodiment illustrated in FIG. 15, the vibration separators 436 comprise non-rotating posts. However, preferably the posts have a surface treatment such that the associated musical string moves easily over the post and tension is readily communicated across the post, but string vibrations are substantially not communicated across the post.

As the force exerted on the pitch adjustment knob 452 is anticipated to be quite large, in the preferred embodiment, the pitch adjustment knob 452 preferably includes a ratcheting mechanism to selectively hold the knob at a desired tension. The ratcheting mechanism may be selectively disengaged by actuation of a latch, button, or the like.

In another embodiment, the knob 452 may be motorized so as to more easily adjust the string system. This may be especially helpful in embodiments that are more complex and involve more string subsystems than are presented in the illustrated embodiment. For example, a piano employing aspects of the embodiment discussed above in connection with FIG. 15 may include several subsystems of one or more strings a piece, and may especially benefit from a motorized adjustment knob. In yet a further embodiment, the motor may be adapted to sense string tension and to automatically adjust position based on such detected tension. For example, the system may automatically adjust itself to remain in tune, so that the correct tension corresponding to a particular desired tune is maintained. Also, the system may be adapted to increase or decrease string tension to change the key of the piano upon actuation by a user. More specifically, upon actuation, the system will sense the current tension, and operate the motor to rotate the knob in order to increase or decrease the tension to a pitch or key indicated by the user. Such pitch is indicated by the tension sensed at the knob.

Figure 16:
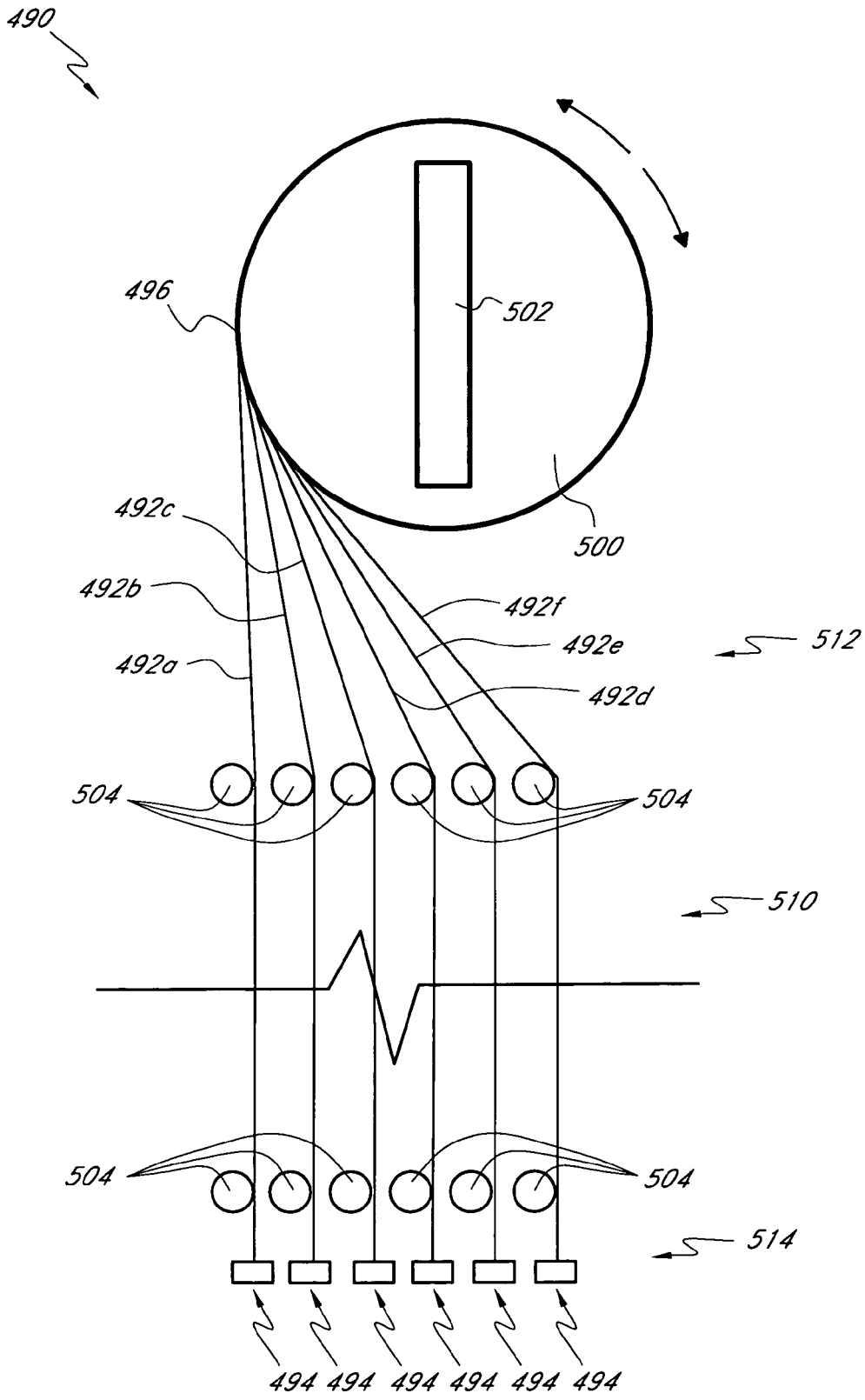
FIG. 16 illustrates an embodiment of a musical string mounting arrangement having a tuning knob for simultaneously adjusting multiple strings.
Figure 17:
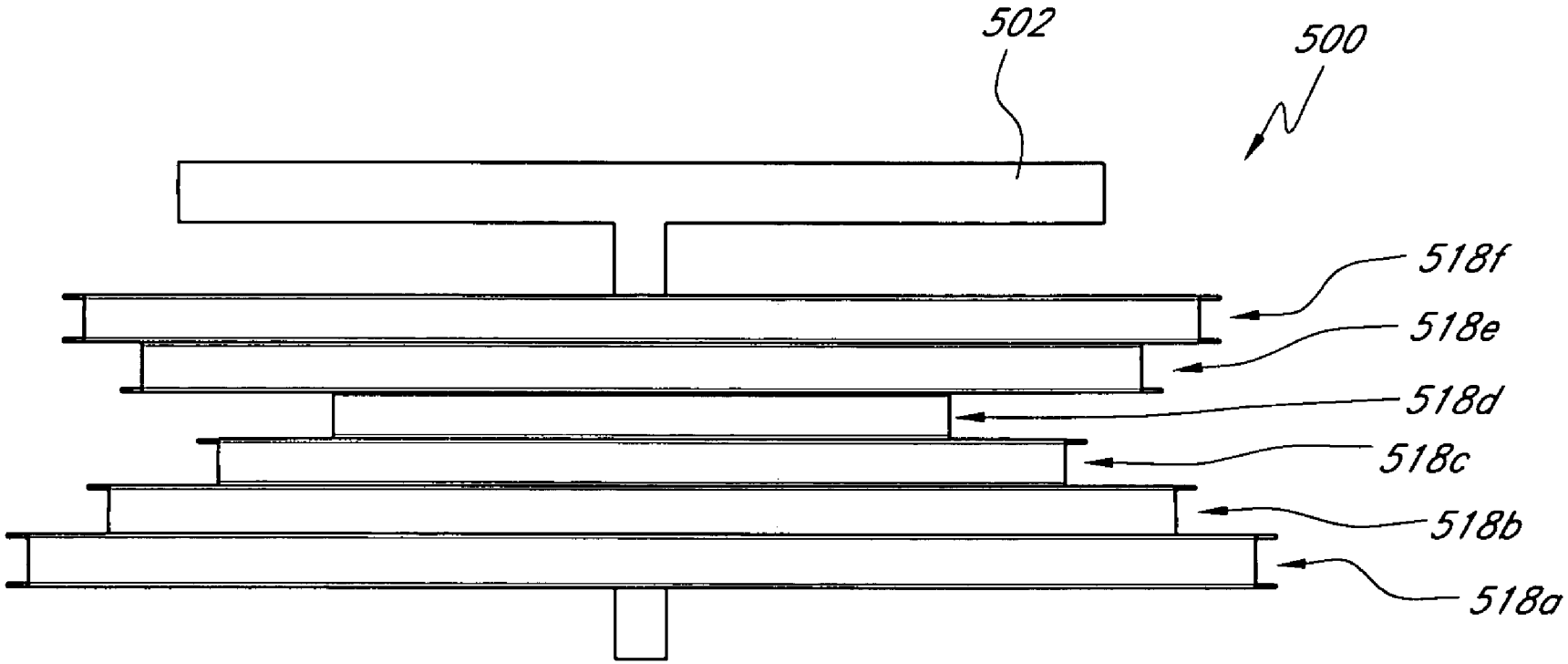
FIG. 17 is a side view of the tuning knob of FIG. 16 showing that strings are relatively tightened differently than each other.

With reference next to FIGS. 16 and 17, another embodiment of a musical string mounting arrangement 490 is illustrated. In the illustrated embodiment, a plurality of musical string segments 492*a-f* each have a first end 494 that is anchored to the musical instrument, and a second end 496 that is attached to a tightening knob 500. The tightening knob 500 is rotatably mounted on the musical instrument, and includes a handle 502 to aid in actuation. A pair of vibration separators 504 are provided for each string segment 492, and define a playing zone 510 between first and second mount zones 512, 514.

As best illustrated in FIG. 17, the tightening knob 500 preferably comprises a plurality of string holders 518*a-f*, each string holder 518 having a different radius. The string holders 518 are adapted to rotate together as the knob 500 is turned. Preferably, the second end 496 of each string 492*a-f* is connected to a respective one of the string holders 518*a-f*. As the tuning member 500 is rotated by a user, a unique distance or tightening, which may or may not be different from that of other strings, is applied for each of the strings 492*a-f* due to the varying radii of the string holders 518*a-f*, and thus a specific tension is applied to each corresponding string segment 492*a-f*. Preferably, the radius of each string holder 518*a-f* is selected so that, upon rotation of the tuning knob 500, the tension of the associated string 492*a-f* changes in accordance with a desired relationship relative to the other strings 492. In this manner, the overall pitch of the string segments 492 can be changed while maintaining the relative tune between individual string segments 492*a-f*.

In the embodiment illustrated in FIGS. 16-17, the construction of the knob 500, including the radii of the string holders 518 is specifically designed to work in connection with strings 492 having certain specified properties. In another embodiment, the knob 500 and strings 492 are provided as a pre-relatively-tuned and assembled unit that can be replaced/installed as a unit. More specifically, the knob may be removably installable on the instrument, and each of the strings 492 may be removably installed on the instrument.

In an additional embodiment, the first end 494 of each string segment 492 is attached to the musical instrument at a tuning key which enables some measure of tightening of the string segment 492. The second end 496 of the string segment 492 is attached to the tightening knob 500 in a manner as discussed above in connection with FIGS. 16 and 17. As such, the tuning knob 500 facilitates adjustments to pitch while maintaining the relative tune of adjacent string segments 492. Additionally, initial tuning, and even fine tuning of such string segments can be accomplished by using the tuning key corresponding to each string segment 492.

Figure 18:
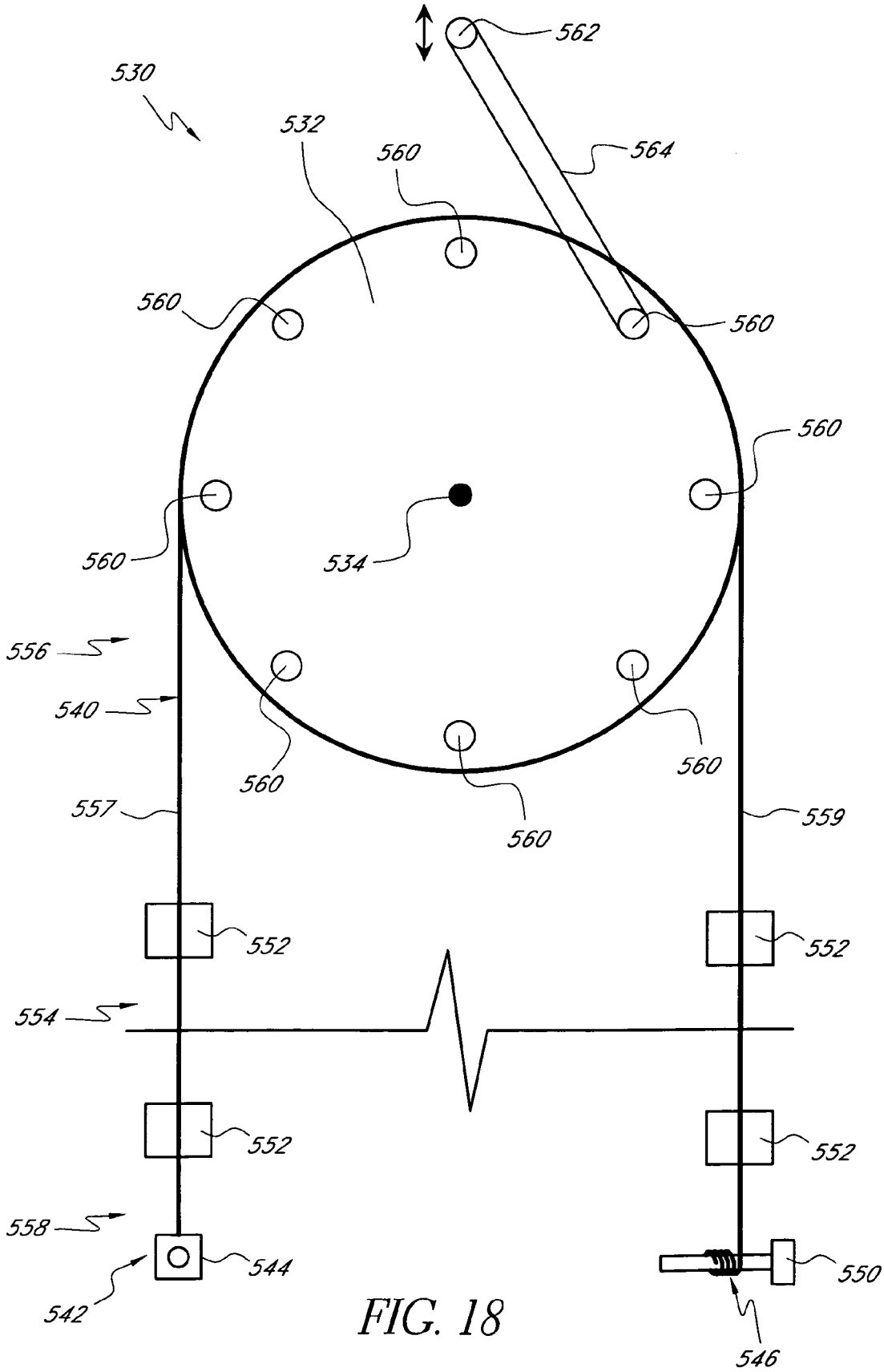
FIG. 18 illustrates a portion of yet another embodiment of a musical string mounting arrangement wherein a relative tension relationship is maintained between string segments.

With reference next to FIG. 18, yet another embodiment of a musical string mounting arrangement 530 is presented. In the illustrated embodiment, a pulley 532 is adapted to rotate about an axis 534. A first end 542 of a musical string 540 preferably is connected to the musical instrument via a connector 544. The string 540 is wrapped at least partially about the pulley 532, and a second end 546 of the string 540 is connected to a tension adjustment knob or tuning key 550 that is attached to the musical instrument. Preferably, vibration separators 552 are provided to define a playing zone 554 between first and second mounting zones 556, 558. A first segment 557 of the musical string 540 extends from the connector 544 to the pulley 532; a second segment 559 of the musical string 540 extends from the pulley 532 to the tuning key 550. Preferably, the pulley 532 comprises one or more posts 560 disposed about the periphery of the pulley 532. A tension adjustment post 562 is provided on the musical instrument and is spaced from the pulley 532. In the illustrated embodiment, a spring member 564 such as an elastic band is selectively attached to both the tension post 562 and one or more of the pulley posts 560.

With continued reference to FIG. 18, in operation, the string 540 is first installed and tuned in at least a rough manner by tightening the string 540 via the tuning key 550. Due to manufacturing variations, when the first and second string segments 557, 559 are at substantially the same tension, they may emit frequencies that aren't quite in relative tune. By applying the spring member to one of the pulley posts 560 and the tension adjustment post 562, the user can effectively increase the tension on one string segment while decreasing the tension in the adjacent string segment. For example, in the illustrated arrangement, the elastic band 564 is placed so as to slightly increase the tension in the second string segment 559 but simultaneously decrease the tension in the first string segment 557. This kind of subtle adjustment may be made to place the string segments 557, 559 into relative tune. Additionally, this arrangement establishes a mathematical tension relationship between the string segments. This mathematical relationship depends upon the spring properties of the elastic member and its placement. As such, once the string segments 557, 559 are in appropriate relative tune with the elastic member 564 in place, the mathematical tension relationship is preserved even if the tuning key 550 is further adjusted over a limited range, and the pitch of the segments 557, 559 may simultaneously be changed while maintaining the relative tune between segments.

In the illustrated embodiment, the tension adjustment post 562 is linearly movable in order to facilitate fine tuning adjustments. It is to be understood that, in other embodiments, the tuning adjustment post 562 need not be linearly movable, and other structures may be selectively employed for biasing a spring force in a desired direction of rotation of the pulley. Also, in another embodiment, a plurality of adjustment posts are provided. In one arrangement, a plurality of posts are arranged generally spaced apart in a row. In another arrangement, an array of posts is provided. Also, the spring member 564 may be chosen from a selection of spring members having various elastic properties in order to customize the relative tuning relationship between the segments 557, 559.

Figure 19:
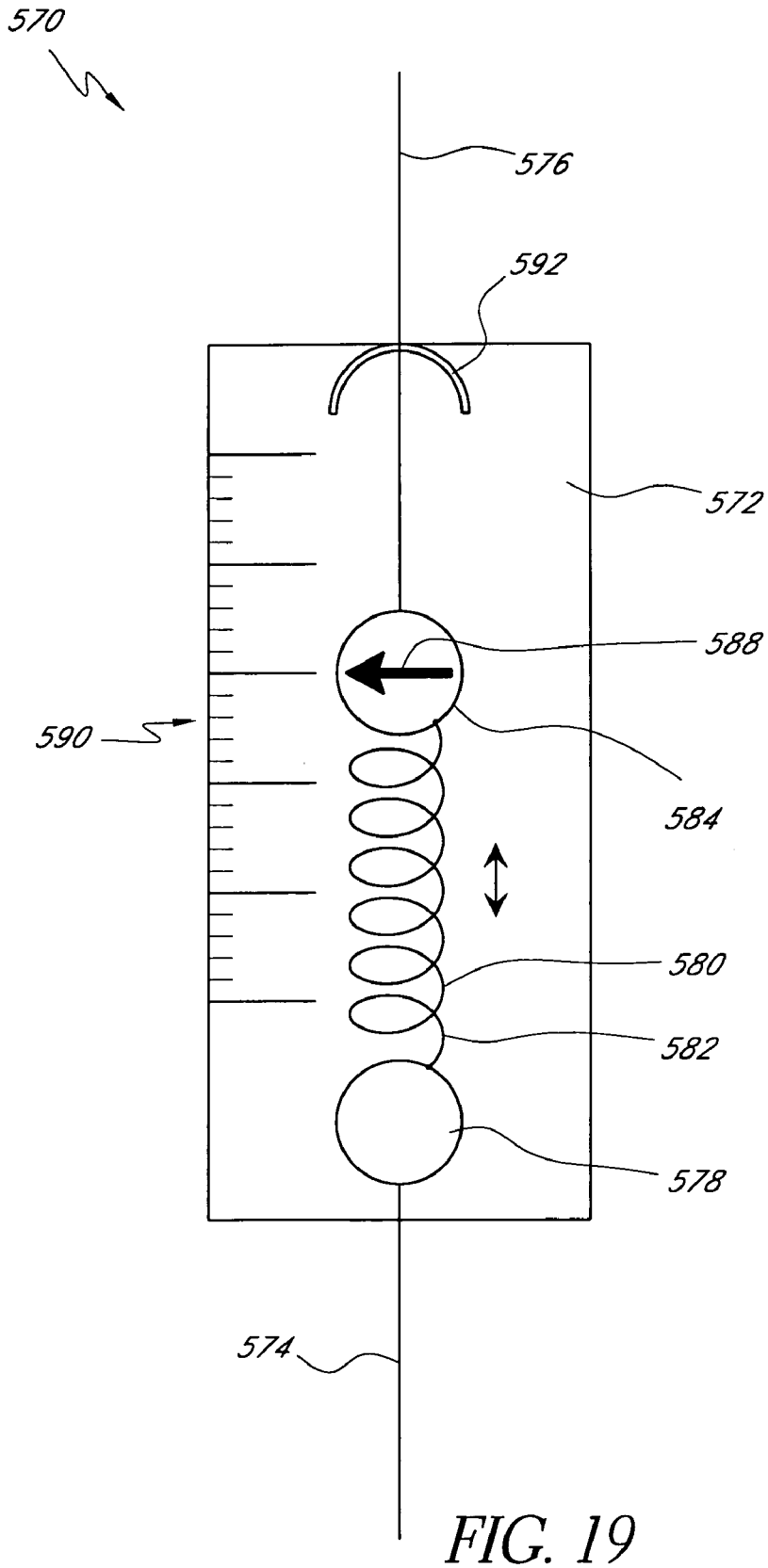
FIG. 19 shows an embodiment of a tension gauge adapted to be used in connection with embodiments of the invention.

With reference next to FIG. 19, an embodiment of a tension gauge 570 is presented. The illustrated gauge 570 is adapted to be placed between ends of first and second string segments 574, 576 that are attached end-to-end. The gauge 570 includes an elongate gauge body 572 having a first attachment portion 578 to which an end of the first string segment 574 is attached. A spring 580 is attached at a first end 582 to the first attachment portion 578 and has a second end 584 which is attached to the second string segment 576. A line guide 592 stabilizes the position of the gauge body 572 relative to the second segment 576.

With continued reference to FIG. 19, an indicator 588 is placed along the spring, preferably at the second end 584. By correlating the position of the indicator 588 relative to a scale 590 printed on the gauge body 572, the user can determine the string tension. Preferably, the scale is labeled to correspond to information relevant to the musician, such as the anticipated frequency or note corresponding to the measured tension for a particular string. Additionally, the scale can demarcate various pitch keys of the string system as a whole.

A tension gauge such as the gauge 570 illustrated in FIG. 19 can be employed in several of the embodiments discussed above. For example, in embodiments discussed in connection with FIG. 10, the tension gauge 570 can be used in place of one or more of the connectors 256. Additionally, a tension gauge could be interposed to measure the tension in each line segment of any embodiment. Additionally, rather than only interposed between two line segments, the gauge can be disposed elsewhere, such as at the connection of the string to the musical instrument.

In the illustrated embodiment, the gauge 570 can function as a visual indicator of correct tune of the string, as the indicator 588 will be aligned with a corresponding mark of the scale 590. If the string tension changes due to string relaxation, environmental factors, or the like, the tension change will be indicated by the gauge 570, as the indicator 588 will have changed alignment. As such, a user may visually check the tune of his instrument by simply looking at the gauge rather than using a tuning apparatus. Accordingly, string tune can be checked and adjusted without having to actually play any string.

The embodiment discussed above in connection with FIG. 19 employs the gauge 570 at connectors between string segments. It is to be understood that, in another embodiment, a stringed instrument may have a more conventional string system in which individual strings are not connected to one another and can be independently tuned. In such an embodiment, a gauge 570 may be supplied for each string. As such, the user will have a visual tune indicator for each string in order to speed tuning and ease checking/verification of tune.

In still another embodiment, a portion of the scale 590 may be movable, such as over a threaded connection. As such, once the associated string is appropriately tuned, the scale is "calibrated", meaning a portion of the scale is moved so as to perfectly align with the indicator 588. Thus, it will be easier for the user to visually notice any movement or variation of the indicator 588 relative to the scale, because a change in the perfect alignment will be easily visible. Such a movement will indicate a change of tension in the string, which corresponds to a change of tune. Tuning of the string can also be easily accomplished by changing tension to once again achieve perfect alignment. As such, minute changes in tune can be visually detected and corrected even before they become audibly detectable.

Figure 20:
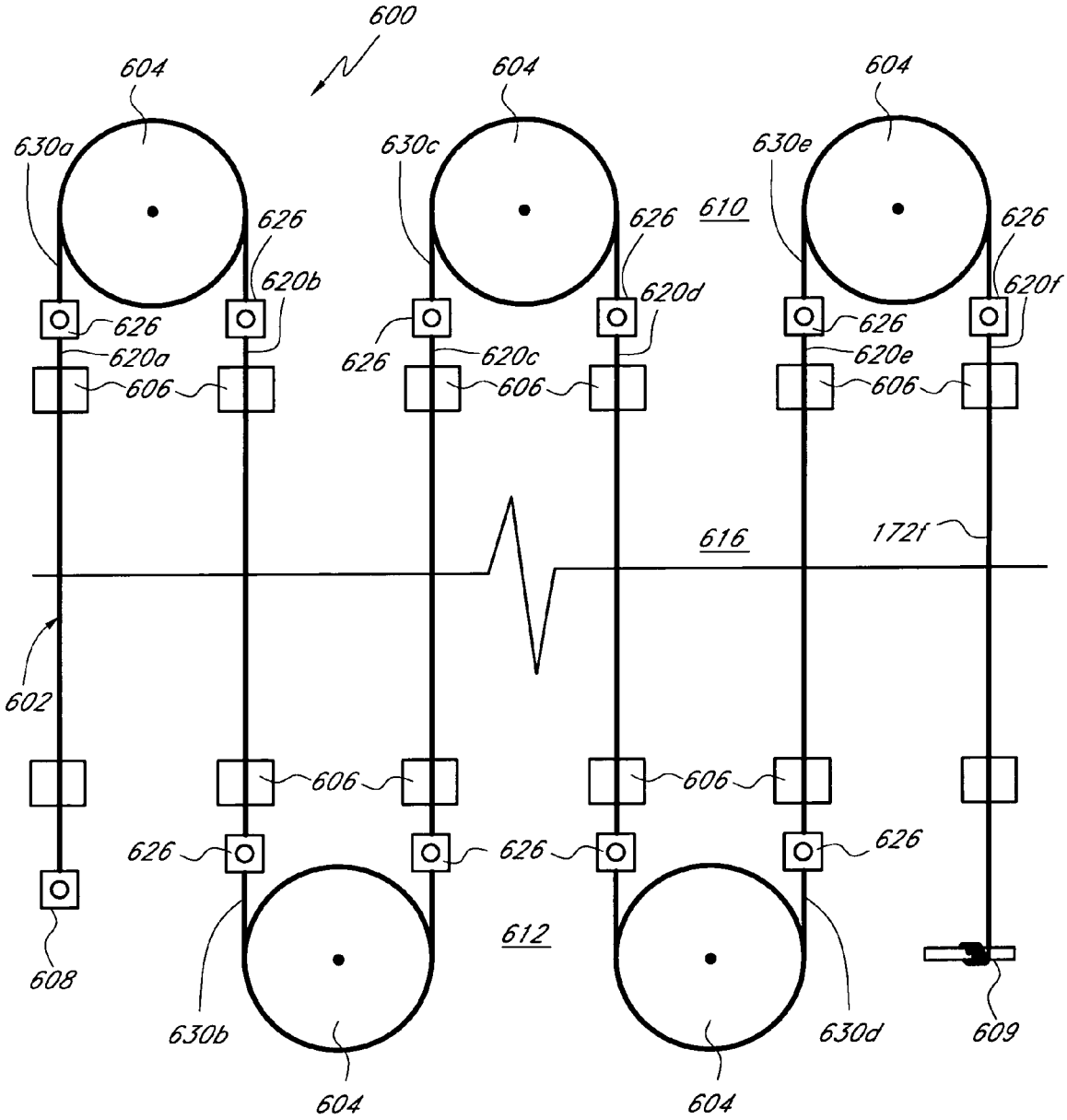
FIG. 20 schematically illustrates a musical string mounting arrangement in accordance with still another embodiment.

With reference next to FIG. 20, another embodiment of a musical string mounting system 600 is presented. In the illustrated embodiment, the string system 600 comprises an elongate composite string 602 that is wrapped about a plurality of pivots 604 along a tortuous, zigzagging path from an anchor 608 to a tensioner 609. In the illustrated embodiment, the pivots 604 comprise rotating pulleys. Vibration separators 606 are provided, and engage the string 602 so as to isolate vibrations in the string 602 on either side of each separator 606, but to communicate string tension thereacross. The composite string 602 engages the pulleys 604, anchor 608 and tensioner 609 in first and second mounting zones 610, 612, which are positioned on opposite sides of a playing zone 616. The vibration separators 606 vibrationally isolate portions of the string 602 in the playing zone 616 from portions of the string 602 in the mount zones 610, 612.

With continued reference to FIG. 20, preferably the composite string 602 comprises six musical string segments 620*a-f*. Each musical string segment 620 is attached end-to-end via a connector 626 to at least one of five bending segments 630*a-e*. As shown, each musical segment 620 is arranged to cross the playing zone 616 and is connected to a bending segment 630 in one of the mounting zones 610, 612. The bending segment 630 engages and bends about the pivot 604 and attaches within the mounting zone 610, 612 to the next musical segment 620, which crosses the playing zone 616.

In a preferred embodiment, the musical string segments 620 are made of musical-quality string so as to emit a desired tone and note at tension. Preferably, the bending segments 630 are made of a material that is very strong longitudinally yet relatively pliable in bending. Preferably, the bending segments 630 are more pliable in bending than are the associated musical segments 620. Most preferably, the bending segments 630 bend readily about the pulleys 604 with little or no resistance. Tension in the composite string 602 thus is not dedicated to bending the string 602 about the pivots 604, but is instead dedicated to maintaining appropriate tune along the string system 600. Since little or no tension is stored in bending material about the pulleys 604, the tension on either side of pulleys 604 and throughout the composite string 602 can be maintained relatively consistent.

Most preferably, the musical string segments 620 stretch longitudinally more readily than the bending segments 630. As such, tensioning of the string system 600 is controlled by longitudinal stretching of the musical segments 620 rather than the bending segments 630.

In one embodiment, the bending segments 630 are made of a collection of filaments arranged in a braid or other structure that compiles or organizes the filaments together. In this specification the term "filament" is a broad term used in accordance with its normal meaning, and includes thin elongate structures such as natural or artificial fibers, fine wires, and the like. Filament materials can include, for example, steel, aluminum, or other metals and alloys, polymers such as nylon, carbon, aramid or glass fibers, and the like. Combinations of filament materials may also be employed.

In another embodiment, at least one of the bending segments is configured as a belt having a width greater than its thickness. In such an embodiment, the pulleys are configured to accommodate the wide belt, which bends readily but resists elongation. In one embodiment, the belt comprises a fabric- or fiber-reinforced rubber. In another embodiment the belt comprises a plurality of thin, elongate filaments reinforced by a fabric. In yet another embodiment, the belt comprises a thin ribbon of material. In a still further embodiment, a bending segment is made of a single elongate wire. In still another embodiment, the bending segment is biased with a curve so as to turn even more easily and with less resistance about the pulley 604.

In a preferred embodiment, the connectors 626 employ a ball-and-connector construction as discussed above in connection with FIGS. 4 and 5. However, it is to be understood that other structures may advantageously be used to connect string segments end-to-end.

The string system 600 embodiment illustrated in FIG. 20 has six musical string segments 620 and is suitable for a musical instrument such as a guitar. Of course, principles discussed in connection with the illustrated embodiment can be employed in various instruments having string systems comprising more or less than six musical string segments.

In yet another embodiment, a stringed instrument having tuning knobs for tensioning a string may employ one or more composite strings, each comprising a bending segment attached to a musical string segment. The bending segment is placed and adapted to wrap about the tuning knob, leaving the musical segment to remain generally straight. Since the bending segment is specifically adapted to easily wrap about the tuning knob, tuning of each composite string is easier for the user, and less or no string tension of the musical segment is dedicated toward tuning the instrument. As such, a bending segment may be suitable for embodiments with or without pulleys.

Variations of the embodiments discussed above can be used in connection with several types and varieties of stringed musical instruments. Such instruments may be conventional, such as a six-string guitar, or unconventional. For example, in one embodiment, a guitar may have stringed playing portions on opposing sides of the neck. In one such embodiment, a single or double (see FIG. 1) pulley arrangement is adapted to communicate string segments to both sides of the neck so that at least two segments of one string are disposed in playing portions on opposed sides. In another embodiment, a pulley arrangement is adapted to direct a string to and between both sides in a generally helical arrangement.

As discussed above, the natural vibrating frequency of a musical string is defined by the equation $f=(\frac{1}{2}L)(T/d)^{1/2}$. In several embodiments disclosed herein, the natural frequencies of adjacent string segments are mathematically related. For example, the natural frequency of a first string segment, $f_1$ may be related to that of a second string segment, $f_2$ by an equation such as $f_2=K_1f_1$, where $K_1$ is a constant. Typically, $K_1$ is defined by properties of the first string segment as compared to the second string segment, such as the density of material used to make the string segment, the effective length L, and even the tension T and/or spring constant k. Once this mathematical relationship is established, simultaneously adjusting the string segments such as for example by simultaneously increasing or decreasing the tension T of the segments, will change the natural frequencies of the segments, yet may maintain the mathematical relationship between segment natural frequencies. Thus, the string segments remain in relative tune. The same holds true in embodiments in which a mechanism such as a composite pulley defines relative proportional tension relationships between strings. In such embodiments, even though the tension in related string segments changes differently, the tension still changes according to a proportional mathematical relationship. Such proportional tension adjustments vary the pitch of the individual segments while maintaining the mathematical relationships of the emitted natural frequency.

In accordance with some embodiments, musical string is constructed of wire manufactured according to very tight tolerances. For example, preferably a string that is adapted to be the high E string of a guitar has a nominal diameter of about 0.009 inches, and a diameter tolerance of less than 1%, more preferably less than 0.25%, and most preferably below 0.1%. As such, consistency of actual natural frequency of the string at a specified tension and effective length is achieved. For example, the guitar high E string nominally vibrates at 330 Hz. Applicant has determined that a string diameter that varies from the nominal diameter by +−0.25% will vibrate at between 329.175 and 330.825 Hz, which corresponds to about 1.65 beats per second. Adherence to 0.1% diameter tolerances will result in under 0.66 beats per second, which is an inaudible difference in tune. Preferably, manufacturing tolerances are such that the variation from nominal frequency generates a beat frequency of less than about 2 beats per second, more preferably less than about 1.65 beats per second, still more preferably less than about 1 beat per second, and most preferably about 0.66 beats per second or less.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. For example, a tuning knob member as provided FIGS. 16 and 17 could be used in an embodiment resembling that shown in FIG. 15; or the gear teeth disclosed in the embodiment discussed in connection with FIG. 11 could also be employed on a pulley having features such as in the embodiment of FIGS. 12*a* and *b*. Further, any of the embodiments discussed herein may be adapted to employ bending segments as discussed above in connection with FIG. 20. Thus, it is intended that the scope of the present invention herein disclosed should not be limited by the particular disclosed embodiments described above, but should be determined only by a fair reading of the claims that follow.

What is claimed is:

1. A stringed musical instrument, comprising:

a composite string comprising a first elongate segment and a second e1ongate segment joined end-to-end, the second segment being more pliable in bending than the first segment;

a string mounting system, the mounting system having a pivot member; and at least one vibration separator, a mount zone being defined on one side of the separator, a playing zone defined on the opposite side of the separator, and the composite string is drawn across the vibration separator;

wherein the second segment is at least partially wrapped about the pivot member so that the direction of the composite string changes at the pivot; and wherein the vibration separator is configured so that string vibrations are substantially blocked from being communicated across the separator.

2. A stringed musical instrument as in claim 1, wherein the pivot member is disposed in the mount zone.

3. A stringed musical instrument as in claim 2, wherein the first segment extends through the playing zone, and the second segment is disposed in the mount zone.

4. A stringed musical instrument as in claim 3, wherein the pivot member comprises a tuning knob.

5. A stringed musical instrument as in claim 3, wherein the pivot member comprises a pulley.

6. A stringed musical instrument as in claim 5, wherein the second segment is joined end-to-end in the mount zone with a third elongate string segment, and the third segment extends through the playing zone, and the second segment is more pliable in bending than is the third segment.

7. A stringed musical instrument as in claim 6, wherein the first segment communicates with an anchor, and the third segment communicates with a tensioner, wherein tension in the first and third segments is substantially the same.

8. A stringed musical instrument as in claim 7, wherein substantially no tension in the composite string is applied to bending the second segment about the pulley.

9. A stringed musical instrument as in claim 8, wherein each of the first and third string segments is configured to emit a musical note when vibrating at its corresponding harmonic frequency, and the emitted notes of the respective string segments differ in accordance with a relative tuning pattern.

10. A stringed musical instrument as in claim 6 additionally comprising a second mount zone defined on a side of the playing zone opposite the first mount zone, a second pulley being arranged in the second mount zone, and a fourth segment is attached end-to-end to the first segment in the second mount zone, wherein the fourth segment is at least partially wrapped about the second pulley.

11. A stringed musical instrument as in claim 10, wherein the composite string is arranged in a continuous loop.

12. A stringed musical instrument as in claim 11, wherein at least one of the pulleys is linearly movable, and moving the movable pulley a predetermined linear distance changes the tension in the composite string.

13. A stringed musical instrument as in claim 3, wherein the first and second segments are formed separately from one another.

14. A stringed musical instrument as in claim 3, wherein the second segment has a width and a thickness, and the width is greater than the thickness.

15. A stringed musical instrument as in claim 14, wherein the second segment comprises a plurality of longitudinally-extending filaments.

16. A stringed musical instrument as in claim 14, wherein the first and second segments are formed separately from one another and are selectively detachable from one another.

17. A stringed musical instrument, comprising:

a composite string comprising a first elongate segment and a second elongate segment joined end-to-end, the first and second segments being formed separately from one another and being selectively detachable from one another, the second segment being more pliable in bending than the first segment; and a string mounting system, the mounting system having a pivot member;

wherein the second segment is at least partially wrapped about the pivot member so that the direction of the composite string changes at the pivot.

18. A stringed musical instrument, comprising:

a composite string comprising a first elongate segment and a second elongate segment joined end-to-end, the first and second segments being formed separately from one another, the second segment having a width and a thickness, the width is being greater than the thickness, the second segment being more pliable in bending than the first segment; and a string mounting system, the mounting system having a pivot member;

wherein the second segment is at least partially wrapped about the pivot member so that the direction of the composite string changes at the pivot.

19. A stringed musical instrument, comprising:

a composite string comprising a first elongate segment and a second elongate segment joined end-to-end, the first and second segments being formed separately from one another, the second segment comprising a plurality of longitudinally-extending filaments and being more pliable in bending than the first segment; and a sting mounting system, the mounting system having a pivot member;

wherein the second segment is at least partially wrapped about the pivot member so that the direction of the composite string changes at the pivot.

20. A stringed musical instrument, comprising:

a composite string comprising a plurality of musical string segments and a plurality of bending string segments, a bending segment being interposed between adjacent musical segments;

a string mounting system having a plurality of pivots, the composite string at least partially wrapped about the pivots so that a direction of the composite string changes at each pivot, the mounting system configured so that the bending segments engage the pivots and the musical segments do not engage the pivots;

wherein each musical string segment has a harmonic frequency corresponding to a string tension and a string length so that vibration of the musical string segment at the harmonic frequency emits sound at a corresponding musical note;

wherein each bending segment is more pliable in bending than the adjacent musical segments;

wherein the string mounting system is configured to hold each string segment at a desired tension so that the plurality of musical string segments are tuned so that each of the musical segments emits a different musical note in accordance with a relative tuning pattern when the composite string is held at a tension; and a string tension adjustment system configured to simultaneously change the tension of each of the plurality of string segments in a manner so that the emitted musical notes of the musical string segments change with the changing tension, but the relative tuning pattern of the notes emitted by the respective musical string segments remains substantially the same.

21. A stringed musical instrument as in claim 20, wherein the tension adjustment system is configured so that actuation of the adjustment system changes the tension in one of the segments to a greater degree than in another of the segments.

22. A stringed musical instrument as in claim 21, wherein the musical instrument comprises at least two groups of string segments, each group comprising at least two segments, wherein the string segments within each group maintain substantially the same proportional tension relationship.

* * * * *